US011195473B2

(12) United States Patent
Chae

(10) Patent No.: US 11,195,473 B2
(45) Date of Patent: Dec. 7, 2021

(54) DISPLAY DEVICE USING INVERTED SIGNAL AND DRIVING METHOD THEREOF

(71) Applicant: LG Display Co., Ltd., Seoul (KR)

(72) Inventor: Jae Kwon Chae, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/886,366

(22) Filed: May 28, 2020

(65) Prior Publication Data

US 2021/0097939 A1 Apr. 1, 2021

(30) Foreign Application Priority Data

Sep. 26, 2019 (KR) ..... 10-2019-0119025

(51) Int. Cl.
*G09G 3/3275* (2016.01)
*G09G 3/3225* (2016.01)

(52) U.S. Cl.
CPC ..... *G09G 3/3275* (2013.01); *G09G 3/3225* (2013.01); *G09G 2310/0297* (2013.01)

(58) Field of Classification Search
CPC ..... G06F 2203/04106; G06F 3/04166; G09G 2300/0443; G09G 3/3614; G09G 3/3659; G09G 2310/0297; G09G 3/3225; G09G 3/3275
See application file for complete search history.

(56) References Cited

U.S. PATENT DOCUMENTS

2008/0165299 A1* 7/2008 Huang ..... G09G 3/3659 349/38

FOREIGN PATENT DOCUMENTS

KR 20110064493 A 6/2011

* cited by examiner

*Primary Examiner* — Gerald Johnson
(74) *Attorney, Agent, or Firm* — Seed IP Law Group LLP

(57) ABSTRACT

Disclosed are a display device using an inverted signal and a driving method thereof. The display device includes a display panel driving circuit for writing data to pixels, a signal generation unit configured to generate a two-step signal for controlling the display panel driving circuit; a plurality of signal lines configured to connect the display panel driving circuit to the signal generation unit; and a signal inversion circuit configured to receive a two-step signal from the signal generation unit, invert the two-step signal, and supply three-step signals each including a positive polarity voltage, a reference level voltage, and a negative polarity voltage to the signal lines.

20 Claims, 27 Drawing Sheets

| | IN1 | IN2 |
|---|---|---|
| t1 | High | Low |
| t2 | Low | Low |
| t3 | Low | High |

DISPLAY DEVICE USING INVERTED SIGNAL AND DRIVING METHOD THEREOF

CROSS-REFERENCE TO RELATED APPLICATION

This application claims priority to and the benefit of Korean Patent Application No. 10-2019-0119025, filed Sep. 26, 2019, the disclosure of which is incorporated herein by reference in its entirety.

BACKGROUND

Technical Field

The present disclosure relates to a display device using an inverted signal and a driving method thereof.

Description of the Related Art

A driving circuit of a flat panel display (FPD) writes pixel data of an input image to pixels of a display panel to reproduce the input image on a pixel array. An FPD includes display panel driving circuits such as a data driving circuit for supplying pixel data signals to data lines and a gate driving circuit for supplying gate signals (or scan signals) to gate lines (or scan lines). An FPD includes a control circuit for controlling a data driving circuit and a gate driving circuit, e.g., a timing controller.

Various methods have been developed to reduce electromagnetic interference (EMI) and noise on signal lines between a timing controller and a display panel driving circuit.

BRIEF SUMMARY

An example of a technique for reducing electromagnetic interference (EMI) on signal lines is a field cancelation technique of generating an inverse-phase signal for a signal transmitted to a display panel driving circuit.

The field cancelation technique has a problem in that a line for transmitting an inverse-phase signal should be additionally included. Also, the field cancelation technique cannot be applied due to the driving characteristics of some display devices. For example, a field cancelation technique applicable to a liquid crystal display device cannot be applied to an organic light-emitting display (OLED).

The present disclosure is directed to solving the aforementioned needs and/or problems.

The present disclosure provides a display device using an inverse signal for removing or reducing EMI and noise from signal lines and minimizing or reducing an increase in the number of lines and a driving method thereof.

It should be noted that objectives of the present disclosure are not limited to the above-described objective, and other objectives that are not described herein will be apparent to those skilled in the art from the following descriptions.

According to an embodiment of the present disclosure, a display device includes a display panel including a plurality of neighboring pixels in areas where a plurality of data lines intersect a plurality of gate lines; a display panel driving circuit configured to write data to the pixels; a signal generation unit configured to generate a two-step signal (i.e., signal in a two-step waveform) for controlling the display panel driving circuit; a plurality of signal lines configured to connect the display panel driving circuit to the signal generation unit; and a signal inversion circuit configured to receive the two-step signal from the signal generation unit, invert the two-step signal, and supply three-step signals (i.e., signal in a three-step waveform) each including a positive polarity voltage, a reference level voltage, and a negative polarity voltage to the signal lines.

The three-step signals applied to the neighboring signal lines have opposite phases.

According to another embodiment of the present disclosure, a display device includes a display panel including a plurality of neighboring pixels in areas where a plurality of data lines intersect a plurality of gate lines; a display panel driving circuit configured to write data to the pixels; a signal generation unit configured to generate a two-step input signal (i.e., signal in the two-step waveform) for controlling the display panel driving circuit; a plurality of signal lines configured to connect the display panel driving circuit to the signal generation unit; a signal inversion circuit configured to receive the two-step input signal from the signal generation unit, invert the two-step input signal, and convert the two-step input signal into three-step signals (i.e., signal in the three-step waveform) each including a positive polarity voltage, a reference level voltage, and a negative polarity voltage; and a recovery circuit configured to convert the three-step signals received from the signal inversion circuit into a two-step output signal and supply the two-step output signal to the signal lines.

The two-step output signal is generated to have a gate high voltage higher than a high voltage of the two-step input signal and a gate low voltage lower than a low voltage of the two-step input signal.

According to still another embodiment, a driving method of a display device includes generating a two-step input signal (i.e., signal in the two-step waveform) for controlling a display panel driving circuit; generating three-step signals (signal in the three-step waveform) each including a positive polarity voltage, a reference level voltage, and a negative polarity voltage by receiving and inverting the two-step input signal; and controlling the display panel driving circuit by supplying the three-step signals to a plurality of signal lines connected to the display panel driving circuit.

According to still another embodiment of the present disclosure, a driving method of a display device includes generating a two-step input signal (i.e., signal in the two-step waveform) for controlling a display panel driving circuit; generating three-step signals (i.e., signal in the three-step waveform) each including a positive polarity voltage, a reference level voltage, and a negative polarity voltage by receiving and inverting the two-step input signal; converting the three-step signals into a two-step output signal; and controlling the display panel driving circuit by supplying the two-step output signal to a plurality of signal lines connected to the display panel driving circuit.

BRIEF DESCRIPTION OF THE SEVERAL VIEWS OF THE DRAWINGS

The above and other objects, features and advantages of the present disclosure will become more apparent to those of ordinary skill in the art by describing exemplary embodiments thereof in detail with reference to the attached drawings, in which.

DETAILED DESCRIPTION

Figure 1:
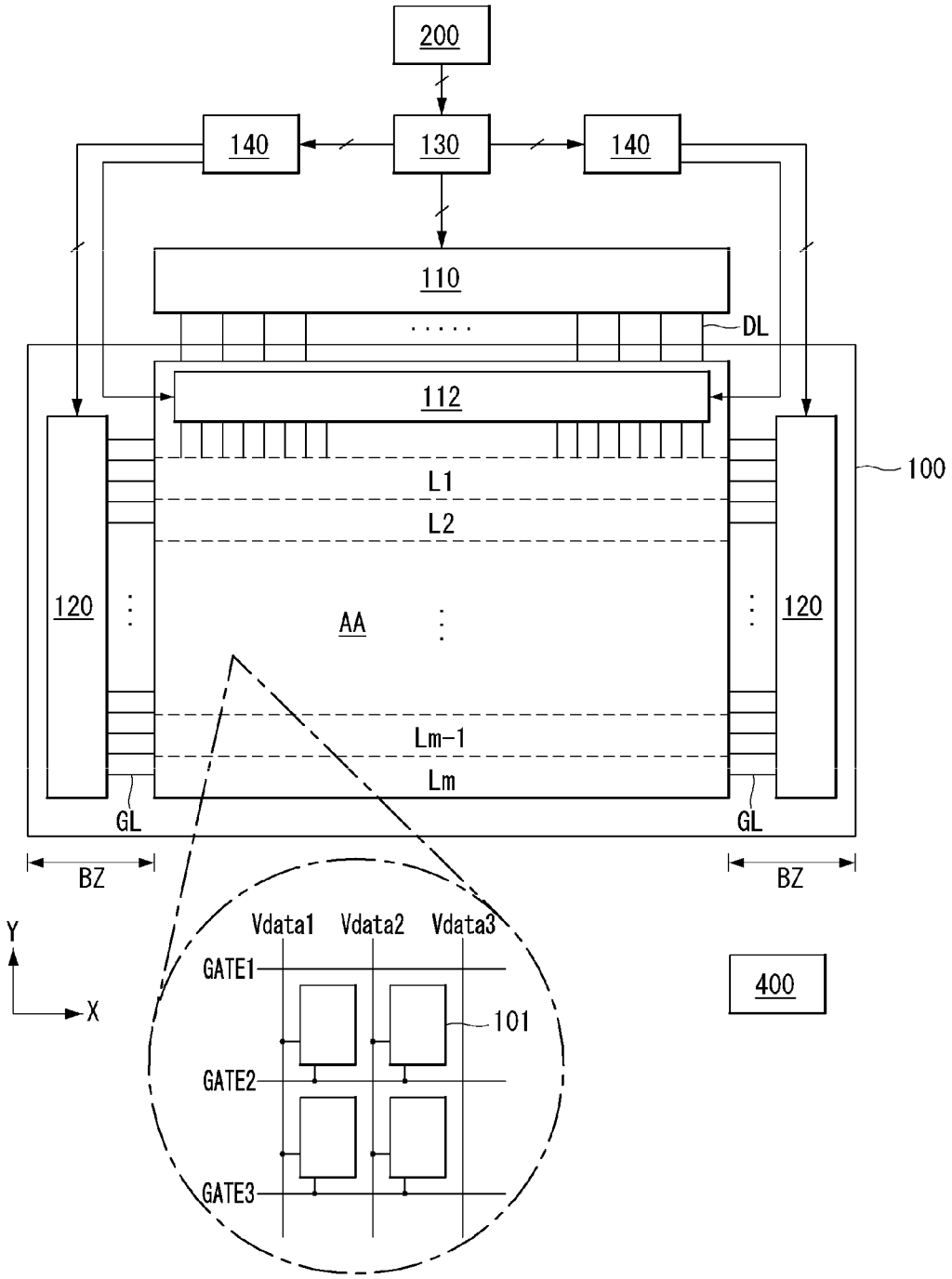
FIG. 1 is a block diagram showing a display device according to an embodiment of the present disclosure.

Advantages and features of the present disclosure, and implementation methods thereof will be clarified through the following embodiments described with reference to the accompanying drawings. However, the present disclosure is not limited to embodiments disclosed herein and may be implemented in various different forms. The embodiments are provided for making the disclosure of the prevention disclosure thorough and for fully conveying the scope of the present disclosure to those skilled in the art. It is to be noted that the scope of the present disclosure is defined by the claims.

The figures, dimensions, ratios, angles, numbers, and the like disclosed in the drawings for describing the embodiments of the present disclosure are merely illustrative and are not limited to matters shown in the present disclosure. Like reference numerals refer to like elements throughout. Further, in describing the present disclosure, detailed descriptions of well-known technologies will be omitted when it is determined that they may unnecessarily obscure the gist of the present disclosure.

Terms such as "including" and "having" used herein are intended to allow other elements to be added unless the terms are used with the term "only." Any references to singular may include plural unless expressly stated otherwise.

Components are interpreted to include an ordinary error range even if not expressly stated.

For description of a positional relationship, for example, when the positional relationship between two parts is described as "on," "above," "below," "next to," and the like, one or more parts may be interposed therebetween unless the term "immediately" or "directly" is used in the expression.

The terms "first," "second," etc., may be used to classify the components, but the functions or structures of the components are not limited by the ordinal numbers or the names of the components. Since the claims are described focusing on essential components, ordinal numbers of the components of the claims may not match the ordinal numbers of the components of the embodiments.

The following embodiments may be partially or entirely bonded to or combined with each other. The embodiments may be interoperated and performed in technically various ways and may be carried out independently of or in association with each other.

In the display device of the present disclosure, a display panel driving circuit, a pixel array, a level shifter, and the like may include transistors. The transistors may be implemented as an oxide thin-film transistor (TFT) including an oxide semiconductor, a low-temperature polysilicon (LTPS) TFT including LTPS, and the like. The transistors may be implemented as transistors with a p-channel or n-channel metal-oxide-semiconductor field-effect transistor (MOSFET) structure.

A transistor is a three-electrode element including a gate, a source, and a drain. The source is an electrode through which carriers are supplied to the transistor. In the transistor, carriers begin to flow from the source. The drain is an electrode through which carriers exit the transistor. The flow of carriers in the transistor is from the source to the drain. In the case of an n-channel transistor, the carriers are electrons. Thus, the source voltage is lower than the drain voltage so that the electrons may flow from the source to the drain. In an n-channel transistor, current flows from the drain to the source. In the case of a p-channel transistor PMOS, the carriers are holes. Thus, the source voltage is higher than the drain voltage so that the holes may flow from the source to the drain. Since the holes in the p-channel transistor flow from the source to the drain, current flows from the source to the drain. It should be noted that the source and drain of the transistor are not fixed. For example, the source and drain may be changed depending on an applied voltage. Accordingly, the present disclosure is not limited by the source and drain of the transistor. In the following description, the source and drain of the transistor will be referred to as first and second electrodes, respectively.

A gate signal is transitioned between a gate-on voltage and a gate-off voltage. The gate-on voltage is set to be a voltage higher than the threshold voltage of the transistor, and the gate-off voltage is set to be a voltage lower than the threshold voltage of the transistor. The transistor is turned on in response to the gate-on voltage while the transistor is turned off in response to the gate-off voltage. In the case of an n-channel transistor, the gate-on voltage may be a gate high voltage VGH, and the gate-off voltage may be a gate low voltage VGL. In the case of a p-channel transistor, the gate-on voltage may be a gate low voltage VGL, and the gate-off voltage may be a gate high voltage VGH.

The present disclosure is applicable to any flat panel display device such as a liquid crystal display (LCD), an organic light-emitting display (OLED), and the like. The display device of the present disclosure includes a signal generation unit configured to generate a control signal for controlling a display panel driving circuit, a plurality of signal lines configured to connect the display panel driving circuit to the signal generation unit, and a signal inverting circuit configured to receive a control signal from the signal generation unit, invert the control signal, and supply a three-step signal including a positive polarity voltage, a reference voltage, and a negative polarity voltage to the signal lines. In this embodiment, the signal inverting circuit will be described as a mixing circuit and/or a level shifter.

Hereinafter, embodiments of the present disclosure will be described in detail with reference to the accompanying drawings.

Referring to FIG. 1, the display device according to an embodiment of the present disclosure includes a display panel 100 and a display panel driving circuit.

The display panel 100 includes a pixel array AA that displays pixel data of an input image. The pixel data of the input image is displayed on pixels of the pixel array AA. The pixel array AA includes multiple data lines DL, multiple gate lines GL intersecting the data lines DL, and a plurality of pixels arranged in areas where the data lines DL intersect the gate lines GL. The pixels may be arranged in a matrix form. The pixels may be formed in various forms such as a form that shares pixels capable of emitting light of the same color, a stripe form, a diamond form, and the like in addition to the matrix form.

The display panel may be produced as a flexible display panel. The flexible display panel may be implemented as a transparent OLED panel using a plastic substrate. A plastic OLED display panel has a pixel array formed on an organic thin film adhered to a back plate.

The back plate of the plastic OLED display may be a polyethylene terephthalate (PET) substrate. The organic thin film is formed on the back plate. A pixel array and a touch sensor array may be formed on the organic thin film. The back plate blocks permeation of moisture to the organic thin film so that the pixel array is not exposed to humidity. The organic thin film may be a thin polyimide (PI) film substrate. A multilayer buffer film may be formed on the organic thin film and formed of an insulating material (not shown). Lines for supplying power or signals applied to the pixel array and the touch sensor array may be formed on the organic thin film.

When the resolution of the pixel array AA is n*m, the pixel array AA includes n pixel columns and m pixel lines L1 to Lm intersecting the pixel columns. The pixel columns include pixels arranged in the y-axis direction. The pixel lines include pixels arranged in the x-axis direction. One horizontal period 1H is a period obtained by dividing one frame period by the m pixel lines L1 to Lm. During one horizontal period 1H, pixel data is written to pixels in one pixel line.

The pixels may be divided into red sub-pixels, green sub-pixels, and blue sub-pixels in order to represent colors. Each of the pixels may further include a white sub-pixel. Each of the sub-pixels 101 includes a pixel circuit. The pixel circuit includes a pixel electrode, multiple thin-film transistors (TFTs), and a capacitor. The pixel circuit is connected to a data line DL and a gate line GL.

Touch sensors may be arranged on the display panel 100 to implement a touch screen. A touch input may be sensed using separate touch sensors or through the pixels. The touch sensors may be implemented as on-cell type or add-on type touch sensors, which are arranged on a screen of a display panel, or may be implemented as in-cell type touch sensors, which are embedded in a pixel array.

The display panel driving circuit includes a data driving unit 110, a gate driving unit 120, and a timing controller 130 for controlling operation timing of the driving circuits 110 and 120. The display panel driving circuit writes data of an input image to pixels of the display panel 100 under the control of the timing controller 130.

The data driving unit 110 converts pixel data of the input image, which is received as a digital signal from the timing controller 130 every frame, into an analog gamma compensation voltage using a digital-to-analog converter (DAC) and outputs data signals such as Vdata1 to Vdata3 shown in FIG. 1. The data signals Vdata1 to Vdata3 are supplied to data lines DL. The data driving unit 110 may be integrated into a source drive integrated circuit (IC) 110*a* shown in FIGS. 7 and 8. The source drive IC 110*a* may be mounted on a chip-on-film (COF) and connected between a source printed circuit board (PCB) 152 and the display panel 100. A touch sensor driving unit for driving the touch sensors may be embedded in the source drive IC 110*a*.

The gate driving unit 120 may be formed in a bezel region BZ of the display panel 100 where no image is displayed. The gate driving unit 120 receives a gate timing control signal from a level shifter 140, generates gate signals (or scan signals) such as GATE1 to GATE3 synchronized with the data signals Vdata1 to Vdata3, and supplies the gate signals GATE1 to GATE3 to the gate lines GL. The gate signals GATE1 to GATE3 applied to the gate lines GL turn on switch elements of the sub-pixels to select pixels charged with the voltage of the data signals Vdata1 to Vdata3. The gate signals GATE1 to GATE3 may be generated as pulse signals swinging between the gate high voltage VGH and the gate low voltage VGL. The gate driving unit 120 shifts a gate signal using a shift register.

The timing controller 130 may multiply an input frame frequency by i (here, i is an integer greater than zero) to control the operation timing of the display panel driving circuit 110 and 120 using a frame frequency equal to the input frame frequency×i Hz. The input frame frequency is 60 Hz for National Television Standards Committee (NTSC) and 50 Hz for Phase-Alternating Line (PAL).

The timing controller 130 receives pixel data of an input image from a host system 200 and receives a timing signal synchronized with the pixel data. The pixel data of the input image received by the timing controller 130 is a digital signal. The timing controller 130 transmits the pixel data to the data driving unit 110. The timing signal includes a vertical synchronization signal Vsync, a horizontal synchronization signal Hsync, a clock signal DCLK, a data enable signal DE, etc. Since a vertical period and a horizontal period may be seen through a method of counting the data enable signal DE, the vertical synchronization signal Vsync and the horizontal synchronization signal Hsync will be omitted. The data enable signal DE has one horizontal period 1H.

The display panel driving circuit may further include a demultiplexer array 112 disposed between the data driving unit 110 and the gate driving unit 120.

Figure 2:
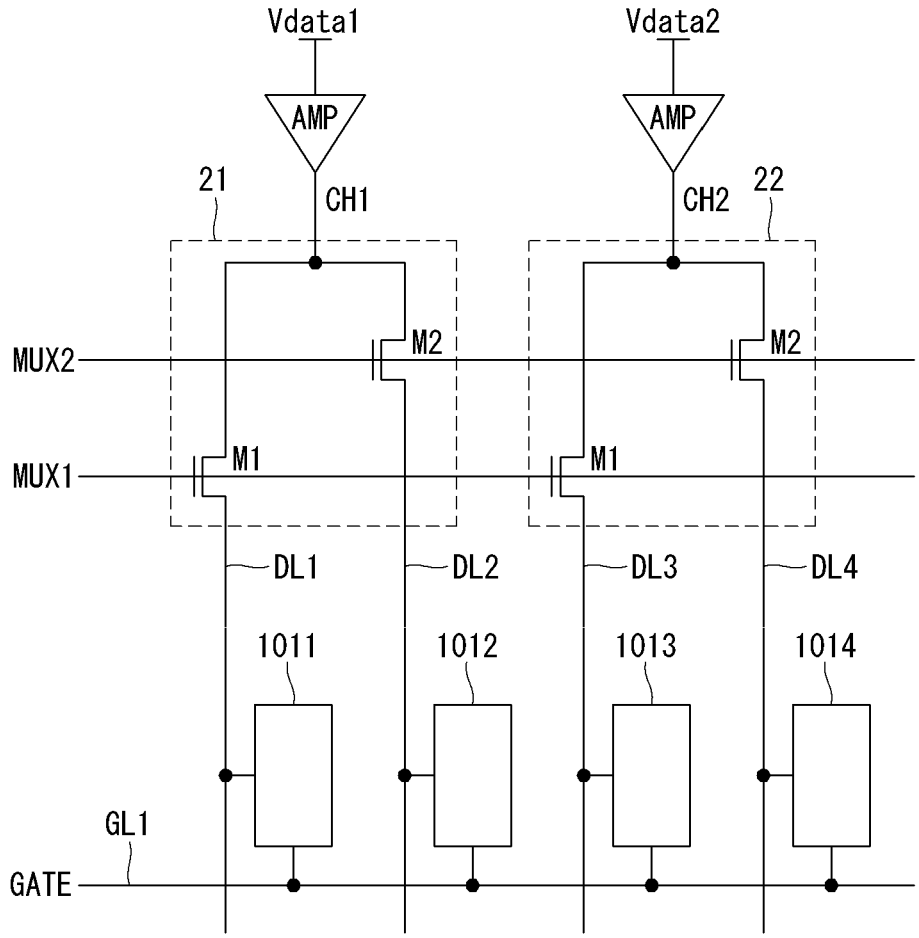
FIG. 2 is a circuit diagram showing switch elements of a demultiplexer array.

The demultiplexer array 112 may reduce the number of channels of the data driving unit 110 by sequentially connecting one channel of the data driving unit 110 to multiple data lines DL and time-divisionally distributing a data voltage output from one channel of the data driving unit 110 to the data lines DL. The demultiplexer array 112 includes multiple switch elements as shown in FIG. 2.

The timing controller 130 may generate a data timing control signal for controlling the data driving unit 110, a gate timing control signal for controlling the gate driving unit 120, a MUX control signal for controlling the switch elements of the demultiplexer array 112, and the like on the basis of timing signals received from the host system 200. The gate timing control signal may include a gate start pulse VST, a shift clock CLK, and the like. The gate start pulse VST controls the start timing of the gate driving unit 120 every frame period. The shift clock CLK controls the shift timing of the gate signal output from the gate driving unit 120. The timing controller 130 may generate a control signal for controlling the level shifter 140.

The host system 200 may be one of a television (TV), a set-top box, a navigation system, a personal computer (PC), a home theater system, a mobile system, and a wearable system. For mobile devices and wearable devices, the data driving unit 110, the timing controller 130, the level shifter 140, and the like may be integrated into one drive IC (not shown).

In the mobile system, the host system 200 may be implemented as an application processor (AP). The host system 200 may transmit the pixel data of the input image to the drive IC through a mobile industry processor interface (MIPI). The host system 200 may be connected to the drive IC through a flexible printed circuit board, e.g., a flexible printed circuit (FPC) 310.

Figure 10:
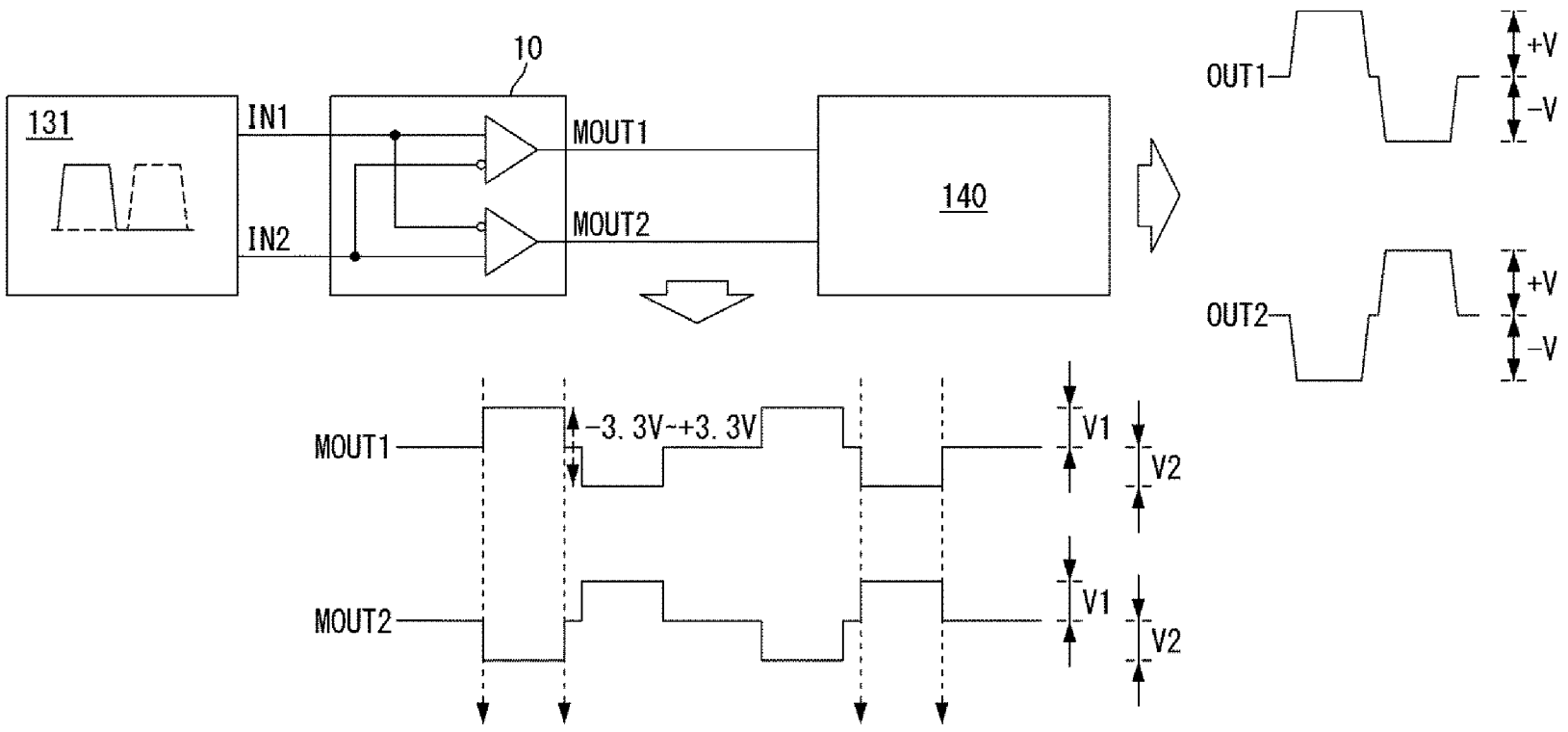
FIGS. 10 and 11 are diagrams showing an example in which a mixing circuit is connected between the signal generation unit and the level shifter.
Figure 11:
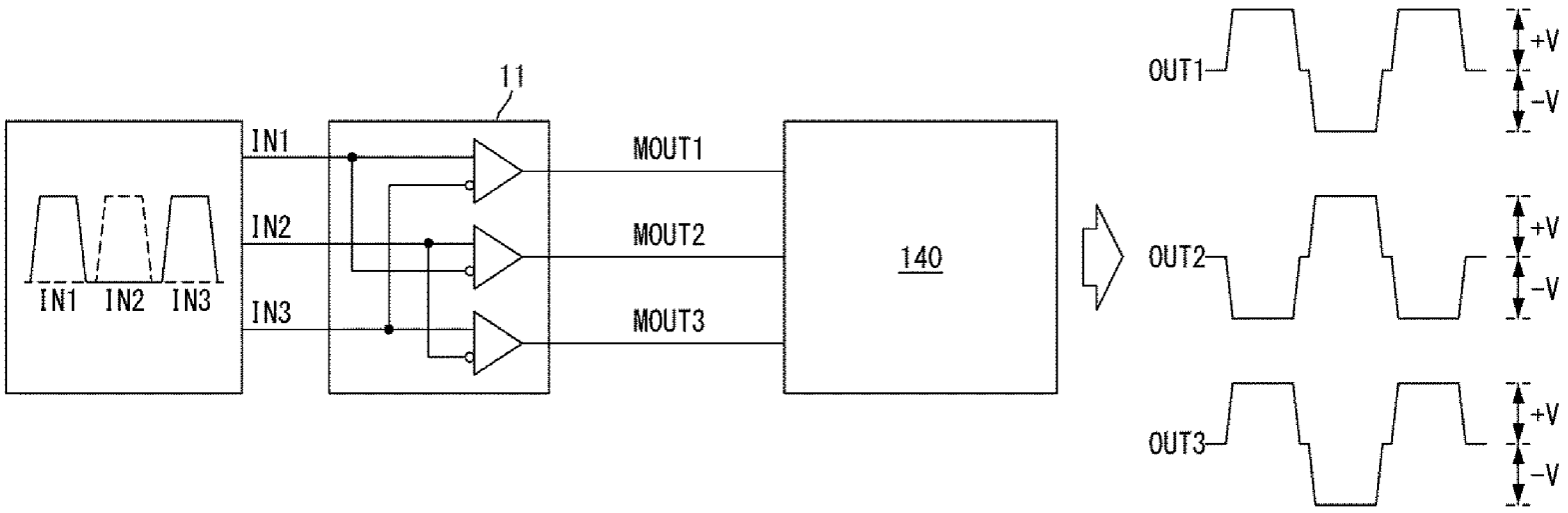

The level shifter 140 may convert an input signal received from the timing controller 130 or the mixing circuit as shown in FIGS. 10 and 11 into a three-step voltage and may output a three-step signal. The three-step signal is a signal including a reference level voltage, a high level voltage higher than the reference level voltage, and a low level voltage lower than the reference level voltage.

The three-step signal as a control signal may include one or more of the data timing control signal, the gate timing control signal, and the MUX control signal. Accordingly, the three-step signal output from the level shifter 140 may be applied to at least one of the demultiplexer array 112, the gate driving unit 120, and the data driving unit 110 to control the circuits.

As another embodiment, the three-step signal output from the level shifter 140 may be converted into a two-step signal, and the two-step signal may be applied to at least one of the demultiplexer array 112, the gate driving unit 120, and the data driving unit 110 to control the circuits.

The display device of the present disclosure further includes a power supply unit 400.

The power supply unit 400 generates a direct current (DC) voltage necessary to drive the display panel driving circuit and the pixel array of the display panel 100 using a DC-DC converter. The DC-DC converter may include a charge pump, a regulator, a buck converter, a boost converter, a buck-boost converter, and the like. The power supply unit 400 may generate DV voltages such as a gamma reference voltage VGMA, gate high voltages VGH and VEH, gate low voltages VGL and VEL, a half VDD HVDD, a common voltage for pixels, and the like by adjusting the DC input voltage received from the host system 200. The gamma reference voltage VGMA is supplied to the data driving unit 110. The half VDD voltage is half of the VDD and may be used as an output buffer driving voltage of the source drive IC. The gamma reference voltage VGMA is divided through a voltage divider circuit on a grayscale basis and is supplied to a DAC of the data driving unit 110.

FIG. 2 is a circuit diagram showing switch elements M1 and M2 of the demultiplexer array 112.

Referring to FIG. 2, an output buffer AMP included in one channel CH1 or CH2 of the data driving unit 110 may be connected to neighboring data lines DL1 to DL4 through the demultiplexer array 112. The data lines DL1 to DL4 may be connected to pixel electrodes 1011 to 1044 of sub-pixels through a thin-film transistor (TFT).

The demultiplexer array 112 includes multiple demultiplexers 21 and 22. The demultiplexers 21 and 22 may be 1:N demultiplexers having one input node and N (N is a positive integer greater than or equal to two) output nodes. The demultiplexers 21 and 22 have a control node connected to the gates of the switch elements M1 and M2 to control the switch elements M1 and M2 according to the MUX control signals MUX1 and MUX2. The MUX control signals MUX1 and MUX2 may be a three-step signal that is output from the level shifter 140 and a two-step signal that is output from a recovery circuit which will be described below.

The demultiplexers 21 and 22 of the demultiplexer array 112 are illustrated as 1:2 demultiplexers in FIG. 2, but the present disclosure is not limited thereto. For example, the demultiplexers 21 and 22 may be implemented as 1:3 demultiplexers and configured to sequentially connect one channel of the data driving unit 110 to three data lines. The demultiplexer array 112 may be directly formed on the substrate of the display panel 100 or may be integrated into one drive IC together with the data driving unit 110.

The demultiplexer array 112 includes a first demultiplexer 21 configured to time-divisionally distribute a data signal Vdata1 output through the first channel CH1 of the data driving unit 110 into the first and second data lines DL1 and DL2 using the switch elements M1 and M2 and a second demultiplexer 22 configured to time-divisionally distribute a data signal output through the second channel CH2 of the data driving unit 110 into the third and fourth data lines DL3 and DL4 using the switch elements M1 and M2.

The switch elements M1 and M2 may be implemented as transistors. The switch elements M1 and M2 are turned on according to the gate high voltage VGH of the MUX control signals MUX1 and MUX2 applied to the gates through the level shifter 140 and configured to connect the channel of the data driving unit 110 to the data lines DL1 to DL4.

The level shifter 140 may convert the MUX control signal received from the timing controller 130 into a three-step signal and may output first and second MUX signals MUX1 and MUX2.

The first switch element M1 is turned on in response to the gate high voltage VGH of the first MUX signal MUX1. In this case, the output buffer AMP of the first channel CH1 is connected to the first data line DL1 through the first switch element M1. At the same time, the output buffer AMP of the second channel CH2 is connected to the third data line DL3 through the first switch element Ml.

The second switch element M2 is turned on in response to the gate high voltage VGH of the second MUX signal MUX2. In this case, the output buffer AMP of the first channel CH1 is connected to the second data line DL2 through the second switch element M2. At the same time, the output buffer AMP of the second channel CH2 is connected to the fourth data line DL4 through the second switch element M2.

Figure 3:
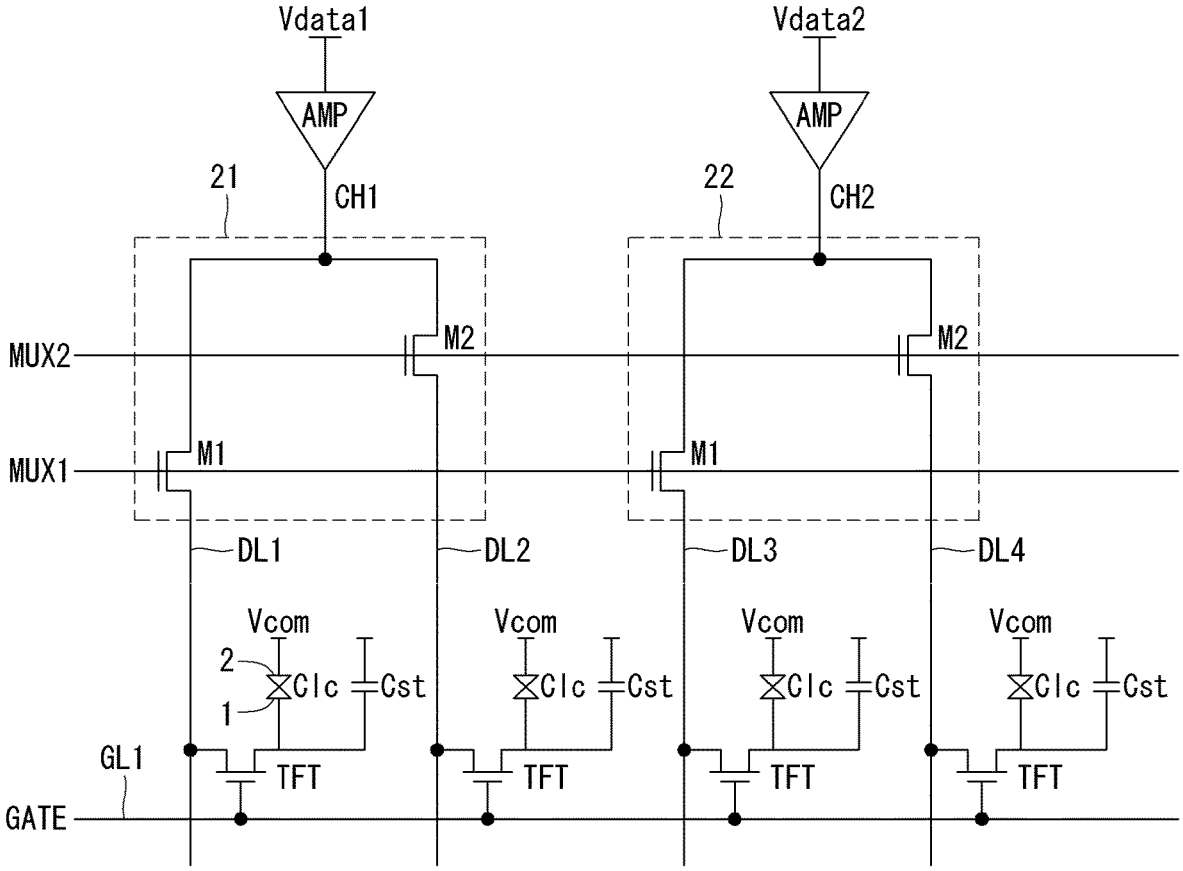
FIG. 3 is a diagram showing an example of a pixel circuit in a liquid crystal display device.

FIG. 3 is a diagram showing an example of a pixel circuit in a liquid crystal display device.

Referring to FIG. 3, each sub-pixel includes a pixel electrode 1, a common electrode 2, a liquid crystal cell Clc, a thin-film transistor connected to the pixel electrode 1, and a storage capacitor Cst. The TFT is formed at intersections between the gate line GL1 and the data line DL1, DL2, or DL3. The TFT supplies the voltage of the data signal Vdata received through the data line DL1, DL2, or DL3 to the pixel electrode 1 in response to the gate signal GATE received through the gate line GATE.

The first demultiplexer 21 is connected between the first channel CH1 of the data driving unit 110 and the data lines DL1 and DL2. The second demultiplexer 22 is connected between the second channel CH2 of the data driving unit 110 and the data lines DL3 and DL4.

Figure 4:
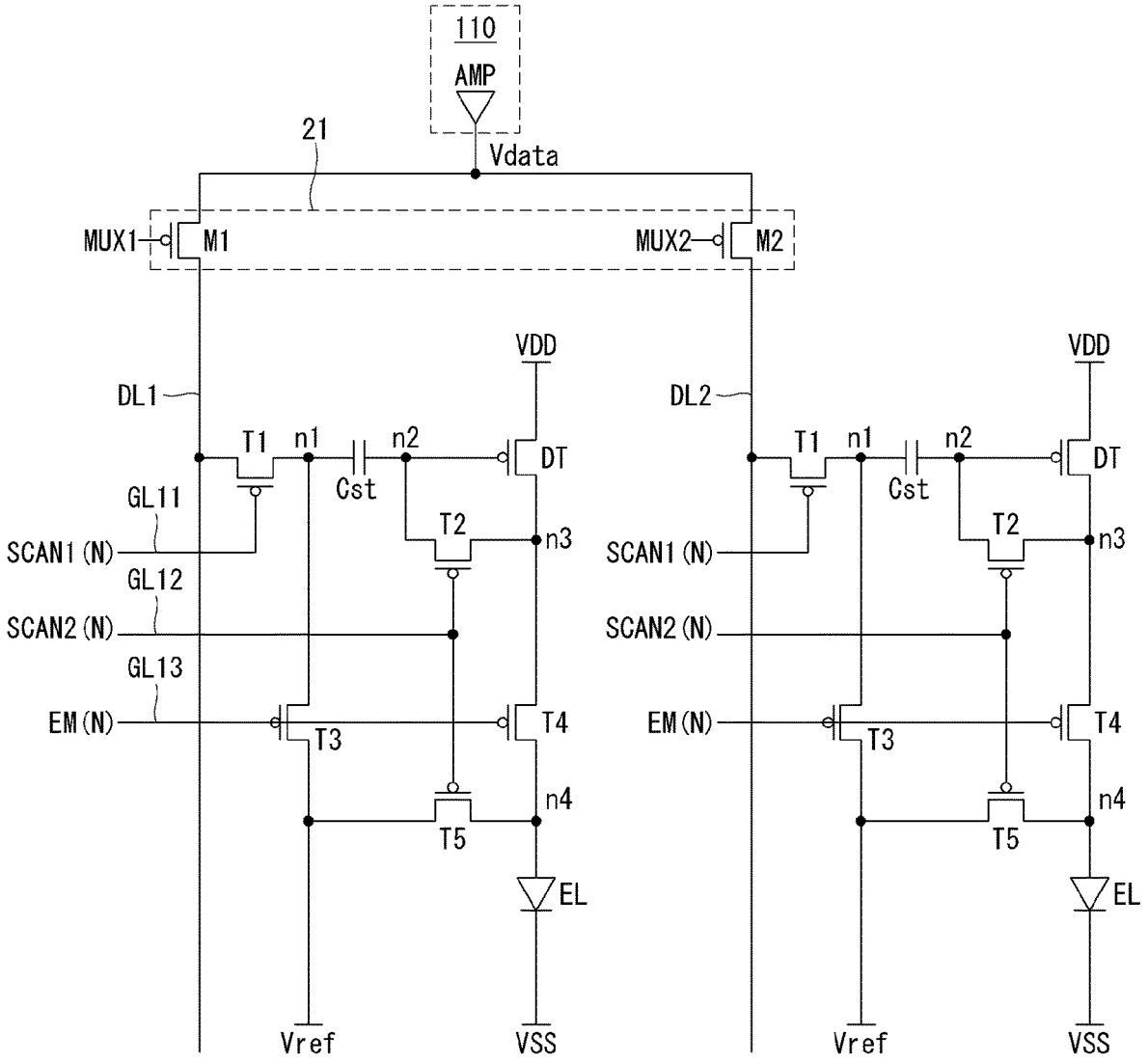
FIG. 4 is a diagram showing an example of a pixel circuit in an organic light-emitting display device.

As shown in FIG. 4 as an example, sub-pixels of an organic light-emitting display device generate light according to pixel data of an input image using an organic light-emitting diode (OLED) and display an image. The organic light-emitting display device does not require a backlight unit and may be implemented on a flexible plastic substrate, a thin glass substrate, or a metal substrate. Accordingly, the flexible display may be implemented as an organic light-emitting display device.

The flexible display may have a screen that is variable in size and form through winding, folding, or bending of the display panel. The flexible display may be implemented as a rollable display, a bendable display, a foldable display, a slidable display, or the like. The flexible display device may be applicable to a TV, a vehicle display, a wearable device, and the like in addition to a mobile device such as a smartphone and a tablet PC, and the fields of application of such flexible display devices are expanding.

The pixels of the organic light-emitting display device include an OLED, a driving element for driving the OLED by adjusting current flowing through the OLED according to a gate-source voltage Vgs, a storage capacitor for maintaining the gate voltage of the driving device, and the like.

The driving element may be implemented as a transistor. In order to uniformize the image quality of the entire screen of the organic light-emitting display device, the driving element may have pixels that all have uniform electrical characteristics. Due to process variations and device characteristic variations caused in the manufacturing process of the display panel, there may be differences in electrical characteristics of driving elements between pixels, and these differences may increase as the driving time of the pixels elapses. In order to compensate for the variations in the electrical characteristics of the driving elements between the pixels, an internal compensation technique and/or an external compensation technique may be applied to an organic light-emitting diode display.

In the external compensation technique, an external compensation circuit is used to sense the current or voltage of the driving element that changes according to the electrical characteristics of the driving element in real time. The external compensation technique compensates for the variations (changes) in the electrical characteristics of the driving element of each pixel by modulating the pixel data (digital data) of the input image by the electrical characteristic variations (changes) of the driving element which are sensed for each pixel.

In the internal compensation technique, an internal compensation circuit embedded in each pixel is used to sense the threshold voltage of the driving element for each pixel and compensate the threshold voltage for the gate-source voltage Vgs of the driving element. The internal compensation circuit includes a storage capacitor Cst connected to the gate of the driving element DT and one or more switch elements T1 to T5 configured to connect the storage capacitor Cst to the driving element DT and a light-emitting element EL.

The multiplexers 21 and 22 may be applied to any organic light-emitting display device to which the internal compensation technique or the external compensation technique is applied. FIG. 4 shows an example in which the multiplexer 21 is disposed in an organic light-emitting display device to which the internal compensation technique is applied, but the present disclosure is not limited thereto.

Figure 5:
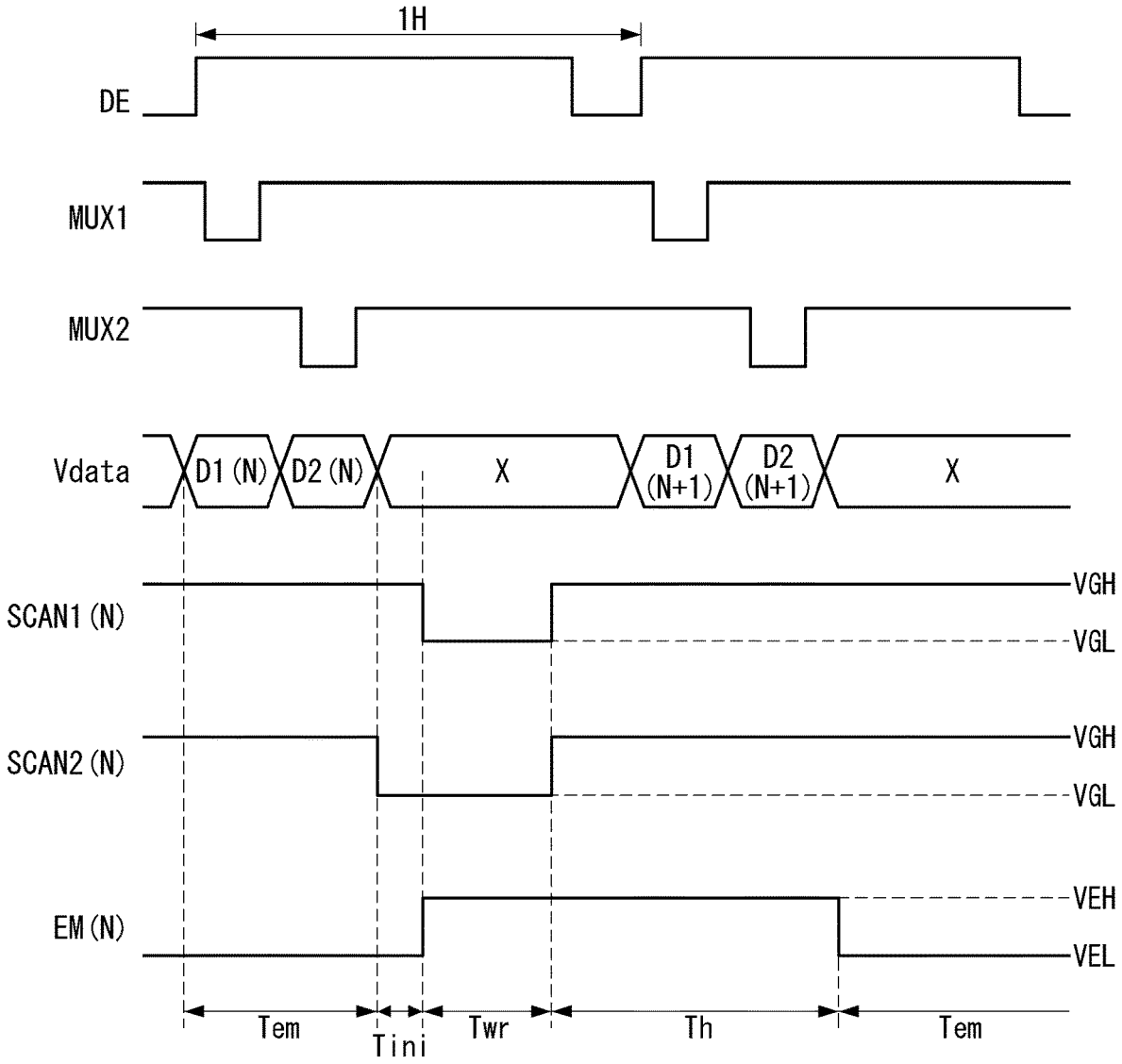
FIG. 5 is a waveform diagram showing operation of the pixel circuit and a demultiplexer shown in FIG. 4.

Referring to FIGS. 4 and 5, the gate signal may include an emission control signal (hereinafter referred to as an "EM" signal) and a scan signal for the organic light-emitting display device. In FIG. 4, GL11 to GL13 are gate lines connected to sub-pixels of one pixel line. D1(N) and D2(N) are data signals Vdata applied to pixels of an Nth pixel line. D1(N+1) and D2(N+1) are data signals Vdata applied to pixels of an (N+1)th pixel line. X is a section where there is no data signal Vdata.

The power supply unit 400 may output DC power such as a pixel driving voltage VDD, a low-potential voltage VSS, and a reference voltage Vref which are applied to the pixels.

During one horizontal period 1H in which data is written to pixels of one pixel line, the pixels may be driven differently depending on an initialization period Tini, a data writing period Twr, and a holding period Th.

The pixels may emit light during an emission period Tem. The emission period Tem corresponds to most of one frame period except for one horizontal period 1H. The holding period Th may be added between the data writing period Twr and the emission period Tem.

In order to precisely express low-grayscale luminance, the EM signal EM(N) may swing between the gate-on voltage VEL and the gate-off voltage VEH at a predetermined duty ratio during the emission period Tem.

The pulse of a second scan signal SCAN2(N) is inverted into the gate-on voltage VGL before the pulse of a first scan signal SCAN1(N) and then is inverted into the gate-off voltage VGH simultaneously with the pulse of the first scan signal SCAN1(N). The pulse widths of the first scan signal SCAN1(N) and the second scan signal SCAN2(N) may be set to be less than or equal to one horizontal period 1H.

The pulse of the EM signal EM may be generated with the gate high voltage VEH to suppress the emission of a light-emitting element EL during the data writing period Twr and the holding period Th. The EM signal EM may be inverted into the gate high voltage VEH when the first scan signal SCAN1(N) is inverted into the gate low voltage VGL and may be inverted into the gate low voltage VEL after the first scan signal SCAN1(N) and the second scan signal SCAN2(N) are inverted into the gate high voltage VEH.

During the initialization period Tini, the second scan signal SCAN2(N) is inverted into the gate low voltage VGL. In this case, the main nodes of the pixel circuit may be initialized.

During the data writing period Twr, the first scan signal SCAN1(N) is inverted into the gate low voltage VGL. In this case, the data signal Vdata is applied to a first electrode of the capacitor Cst, and VDD minus Vth is applied to a second electrode of the capacitor Cst. During the data writing period Twr, the driving element DT is turned off when the gate-source voltage Vgs of the driving element DT reaches the threshold voltage Vth of the driving element DT. Thus, the threshold voltage Vth of the driving element DT is sampled for the capacitor Cst, and the capacitor is charged with the data voltage Vdata for which the threshold voltage is compensated.

The light-emitting element EL may be implemented as an OLED. The OLED includes an organic compound layer formed between an anode and a cathode. The organic compound layer of the OLED may include a hole injection layer HIL, a hole transport layer HTL, an emission layer EML, an electron transport layer ETL, an electron injection layer EIL, and the like, but the present disclosure is not limited thereto. The anode of the light-emitting element EL is connected to fourth and fifth switch elements T4 and T5 through a fourth node n4.

The low-potential power voltage VSS is applied to the cathode of the light-emitting element EL. The driving element DT supplies current to the light-emitting element EL according to the gate-source voltage Vgs to drive the light-emitting element EL. The light-emitting element EL emits light using current adjusted by the driving element DT according to the voltage of the data signal Vdata. The electric current path of the light-emitting element EL is switched by the fourth switch element T4.

The capacitor Cst is connected between a first node n1 and a second node n2. The capacitor Cst is charged with the voltage of the data signal for which the threshold voltage Vth of the driving element DT is compensated. Since the threshold voltage Vth of the driving element DT is compensated for the voltage of the data signal Vdata for each sub-pixel, threshold voltage variations may be compensated for in the sub-pixels.

The first switch element T1 is turned on in response to the gate low voltage VGL of the first scan signal SCAN1(N) to supply the voltage of the data signal Vdata to the first node n1. The first switch element T1 includes a gate connected to the first gate line GL11 through which the first scan signal SCAN1(N) is applied, a first electrode connected to the data lines DL1 and DL2, and a second electrode connected to the first node n1.

The second switch element T2 is turned on in response to the gate low voltage VGL of the second scan signal SCAN2(N) to connect the gate of the driving element DT to the second electrode. The second switch element T2 includes a gate connected to the second gate line GL12 through which the second scan signal SCAN2(N) is applied, a first electrode connected to the second node n2, and a second electrode connected to the third node n3.

The third switch element T3 is turned on in response to the gate low voltage VEL of the EM signal EM(N) to supply the reference voltage Vref to the first node n1 during the initialization period Tini and the emission period Tem. Due to the third switch element T3, the voltage of the first electrode of the capacitor Cst is initialized to Vref during the initialization period Tini and the emission period Tem. The third switch element T3 includes a gate connected to the third gate line GL13 through which the EM signal EM(N) is applied, a first electrode connected to the first node n1, and a second electrode connected to a Vref line through which Vref is applied.

The fourth switch element T4 is turned on in response to the gate low voltage VEL of the EM signal EM(N) to connect the third node n3 to the fourth node n4 during the initialization period Tini and the emission period Tem. The fourth switch element T4 has a gate connected to the third gate line GL13. The fourth switch element T4 has a first electrode connected to the third node n3 and a second electrode connected to the fourth node n4.

The fifth switch element T5 is turned on in response to the gate low voltage VGL of the second scan signal SCAN2(N) to supply Vref to the fourth node n4 during the initialization period Tini and the data writing period Twr. The fifth switch element T5 has a gate connected to the second gate line GL12. The fifth switch element T5 has a first electrode connected to the Vref line and a second electrode connected to the fourth node n4.

The driving element DT is operated as a diode by the second switch element T2 which is turned on during the data writing period Twr. The threshold voltage Vth of the driving element DT is sampled during the data writing period Twr. The driving element DT drives the light-emitting element EL by adjusting current flowing through the light-emitting element EL according to the gate-source voltage Vgs during the emission period Tem. The driving element DT includes a gate connected to the second node n2, a first electrode connected to a VDD line through which VDD is applied, and a second electrode connected to the third node n3.

Figure 6:
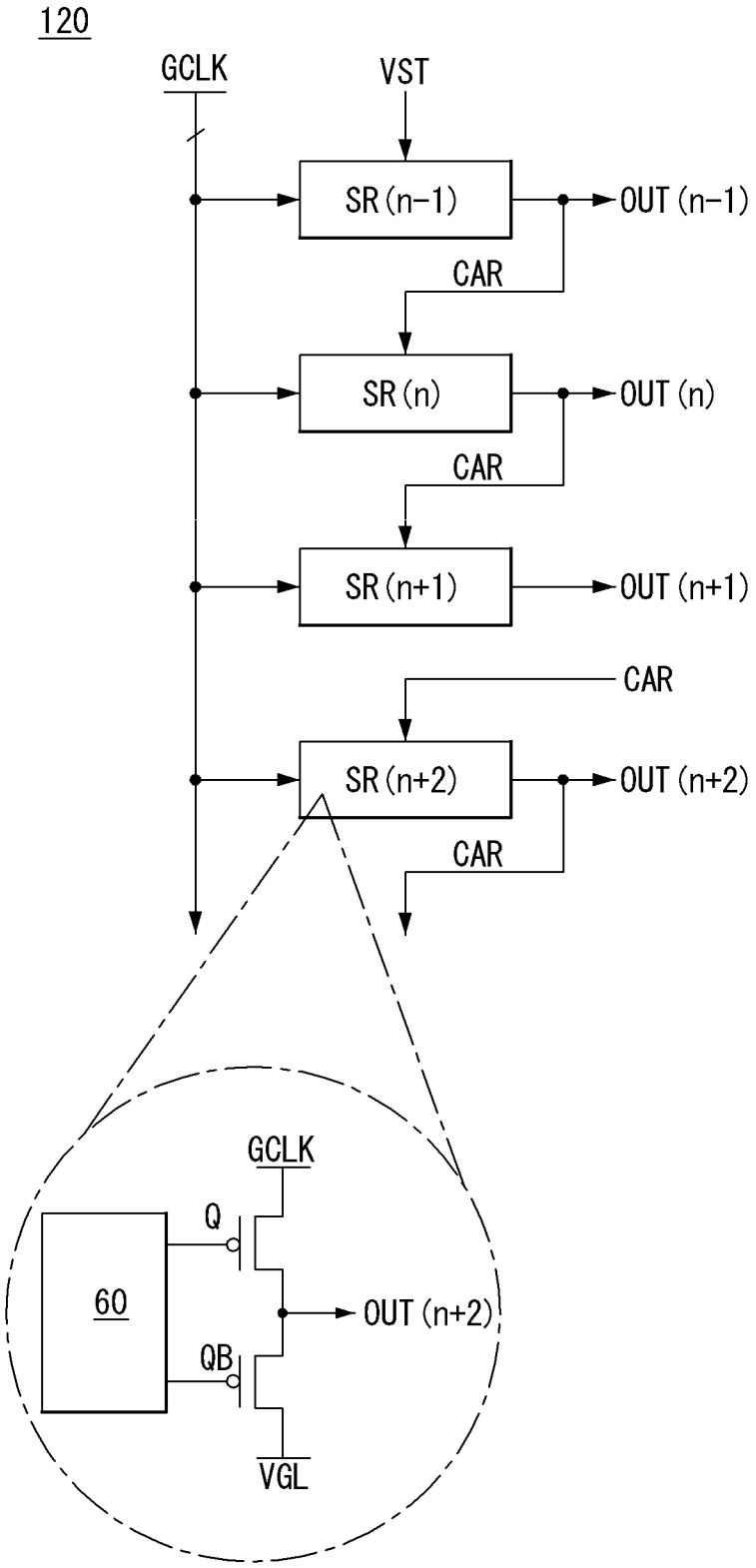
FIG. 6 is a diagram schematically showing a shift register of a gate driving circuit.

FIG. 6 is a diagram schematically showing a shift register of the gate driving unit 120. The shift register of the gate driving unit 120 includes stages SR(n−1) to SR(n+2) which are connected in cascade. The shift register receives a start pulse VST or a carry signal CAR and generates output signals OUT(n−1) to OUT(n+2) in accordance with shift clock CLK timing. The carry signal CAR may be output from the previous stage.

Each of the stages SR(n−1) to SR(n+2) includes a control unit 60 configured to charge or discharge a Q node and a QB node and a buffer configured to charge a gate line according to the voltage of the Q node to raise the waveform of a gate signal and configured to discharge the gate line according to the QB node. The buffer includes a pull-up transistor Tu and a pull-down transistor Td. The output signals OUT(n−1) to OUT(n+2) of the stages SR(n−1) to SR(n+2) are gate signals that are sequentially applied to the gate lines.

The gate timing control signals VST and CLK may be a three-step signal or a two-step signal that is output from the level shifter.

Figure 7:
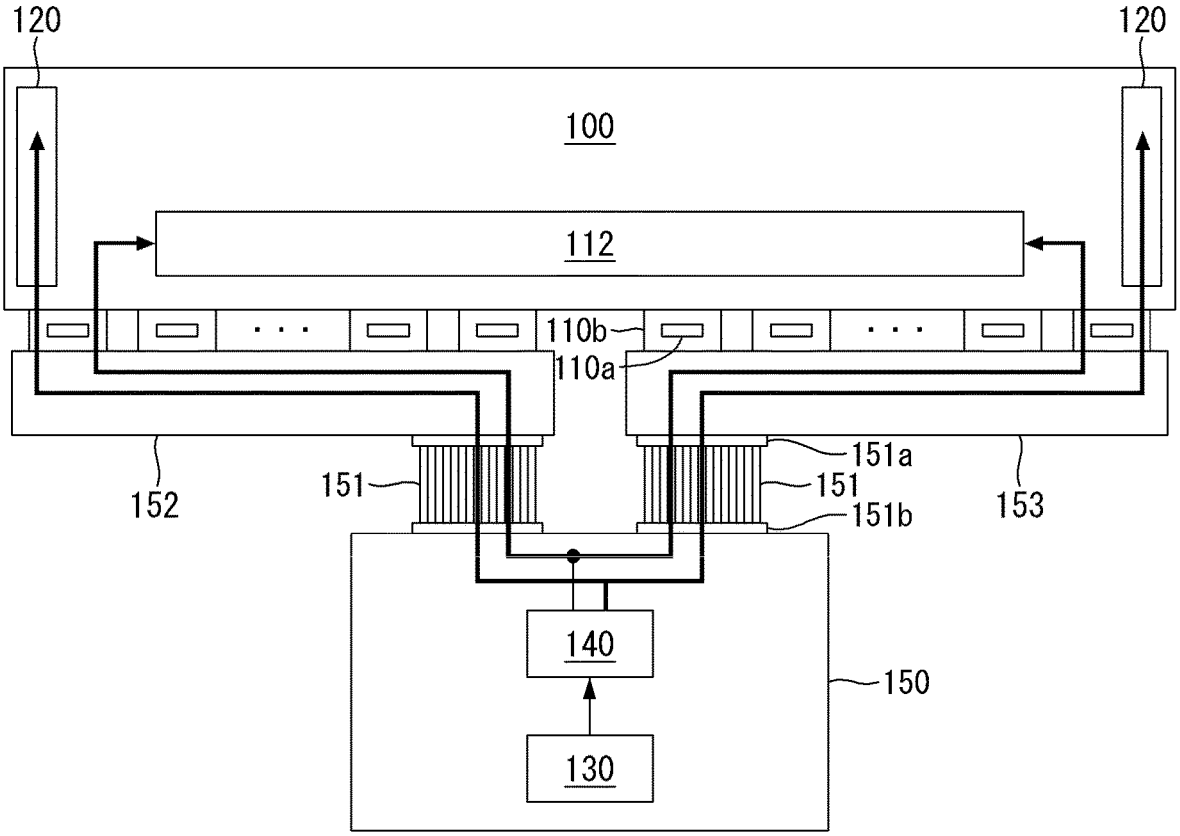
FIGS. 7 and 8 are diagrams showing lines between a timing controller and a level shifter.
Figure 8:
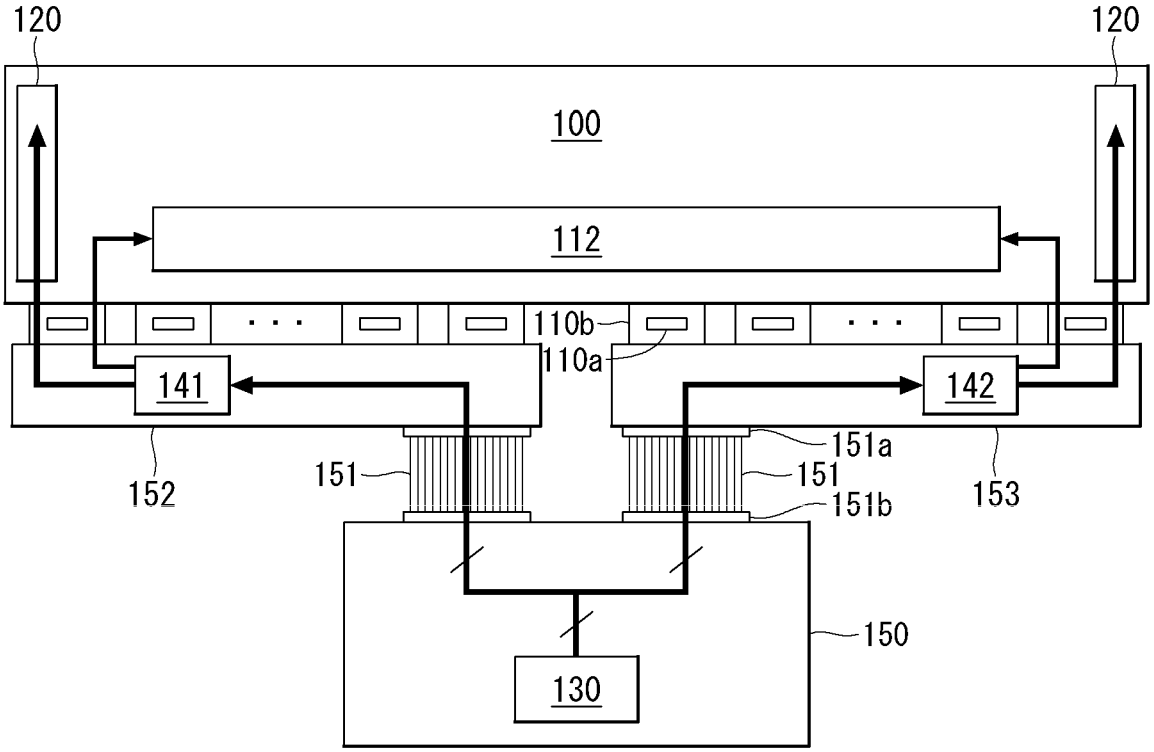

For a large screen display device, the source PCB 152 may be divided by two. FIGS. 7 and 8 are diagrams showing signal lines between the timing controller 130 and the level shifter 140 in the large screen display device.

Referring to FIGS. 7 and 8, a control board 150 may be connected to a first source PCB 152 and a second source PCB 153 through a flexible circuit board, for example, a flexible flat cable (FFC) 151 and connectors 151*a* and 151*b*.

Source drive ICs 110*a* are connected between a display panel 100 and source PCBs 152 and 153.

A timing controller 130 and a level shifter 140 may be mounted on the control board 150, as shown in FIG. 7. In this case, input ports of the level shifter 140 are connected to the timing controller 130 through lines formed on the control board 150. Output ports of the level shifter 140 may be connected to the gate driving unit 120 through lines connecting the FFC 151, the source PCBs 152 and 153, a chip-on-film (COF) 110*b*, and the gate driving unit 120 disposed on the display panel 100.

The level shifter 140 may be mounted on each of the source PCBs 152 and 153, as shown in FIG. 8. In this case, the level shifter 140 may include a first level shifter 141 mounted on the first source PCB 152 and a second level shifter 142 mounted on the second source PCB 153. Input ports of each of the level shifters 141 and 142 are connected to the timing controller 130 through lines connecting the control board 150, the FFC 151, and the source PCBs 152 and 153. Output ports of each of the level shifters 141 and 142 may be connected to the gate driving unit 120 through lines connecting the source PCBs 152 and 153, the COF 110*b*, and the gate driving unit 120 disposed on the display panel 100.

Figure 9:
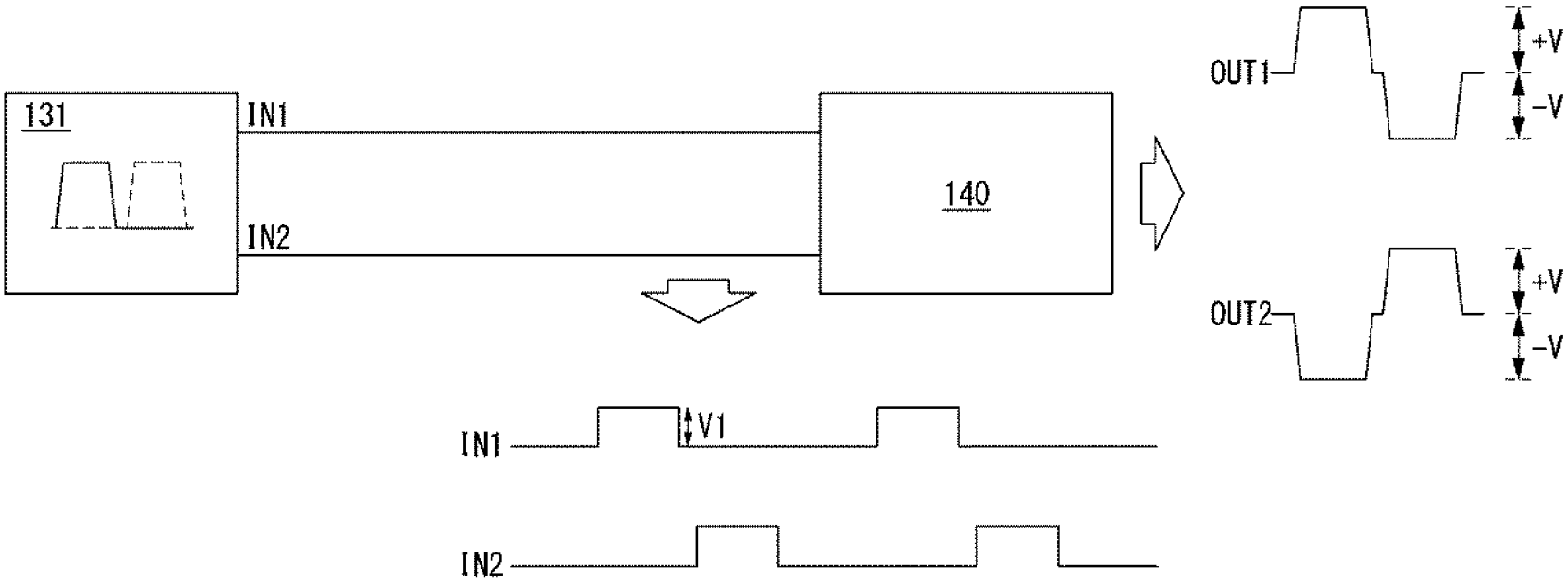
FIG. 9 is a diagram showing output signals of a signal generation unit and a level shifter.

The timing controller 130 may generate a control signal for controlling the display panel driving circuit using a signal generation unit 131 as shown in FIGS. 9 to 11.

FIG. 9 is a diagram showing output signals of the signal generation unit 131 and the level shifter 140.

Referring to FIG. 9, the signal generation unit 131 generates first and second signals IN1 and IN2 of a pulse type. The signal generation unit 131 may sequentially output the pulses of the first and second signals IN1 and IN2 using a shift register. The first and second input signals IN1 and IN2 may be output as a two-step pulse of a transistor-transistor logic (TTL) voltage level between 0 V and 3.3 V.

The level shifter 140 receives a two-step signal from the signal generation unit 131 and outputs a three-step signal. The level shifter 140 inverts the first and second input signals IN1 and IN2 received from the signal generation unit 131 and outputs first and second output signals OUT1 and OUT2 with opposite phases. The first and second output signals OUT1 and OUT2 may be generated to have voltages higher than the voltages of the first and second input signals.

When the first output signal OUT1 is a positive polarity voltage +V, the second output signal OUT2 is a negative polarity voltage −V. Conversely, when the first output signal OUT1 is a negative polarity voltage −V, the second output signal OUT2 is a positive polarity voltage +V. Accordingly, when the first and second output signals OUT1 and OUT2 are applied to neighboring signal lines, a field cancelation effect occurs.

The output signals OUT1 and OUT2 may be three-step signals having opposite polarities and may include a reference level voltage, the pulse of a positive polarity voltage +V higher than the reference level voltage, and the pulse of a negative polarity voltage −V lower than the reference level voltage. The reference level voltage may be the gate low voltage VGL. The positive polarity voltage +V may be a voltage higher than the high voltage (=3.3 V) of the input signals IN1 and IN2, for example, the gate high voltage VGH. The gate high voltage VGH may be a voltage of 20 V or higher. The negative polarity voltage −V may be a negative polarity voltage lower than the gate low voltage VGL. The negative polarity voltage −V may be selected from among voltages lower than the gate low voltage VGL. The negative polarity voltage −V may vary depending on the operating characteristics of the display panel driving circuit.

The first and second output signals OUT1 and OUT2 may be transmitted to the display panel driving circuits 110, 112, and 120 through neighboring signal lines. Accordingly, since signals with opposite phases are transmitted through neighboring signal lines, a field cancelation effect occurs, and thus it is possible to minimize or reduce electromagnetic interference (EMI) and noise.

The display panel driving circuit includes transistors having gates to which the output signals OUT1 and OUT2 of the level shifter 140 are to be applied. These transistors may deteriorate due to gate bias stress when voltages having the same polarity are continuously applied as the gate voltage or when a DC voltage is applied as the gate voltage. For example, the threshold voltage of the transistor may be shifted due to the gate bias stress.

The three-step signal transitions between a positive polarity voltage and a negative polarity voltage. Thus, by applying the three-step signal to transistors, it is possible to alleviate the accumulation of the gate bias stress, and it is also possible to recover from the stress using voltages with opposite polarities. Accordingly, the transistors of the display panel driving circuit controlled by the output signals OUT1 and OUT2 of the level shifter have reduced deterioration and thus may have a stable operation and extended lifespan.

FIGS. 10 and 11 are diagrams showing an example in which a mixing circuit 10 is connected between the signal generation unit 131 and the level shifter 140. FIG. 10 shows an example of a differential-type mixing circuit. FIG. 11 shows an example of a cascade-type mixing circuit.

The mixing circuit 10 may be connected between the signal generation unit 131 and the level shifter 140.

Referring to FIG. 10, the mixing circuit 10 inverts the first and second input signals IN1 and IN2 received from the signal generation unit 131 and thus outputs first and second output signals MOUT1 and MOUT2 which have opposite phases. Each of the output signals MOUT1 and MOUT2 is generated as a three-step signal having a three-step voltage.

The first and second output signals MOUT1 and MOUT2 include pulses generated from the inverted signals of the pulses of the first and second input signals IN1 and IN2 and thus include the pulse of the positive polarity voltage V1 and the pulse of the negative polarity voltage V2. The first and second input signals IN1 and IN2 may be output as a two-step pulse of 0 V to 3.3 V. In this case, the positive polarity voltage V1 of the first and second output signals MOUT1 and MOUT2 may be a voltage of +3.3 V, and the negative polarity voltage V2 may be a voltage of −3.3 V. In the first and second output signals MOUT1 and MOUT2, a reference level section is present between the pulse of the positive polarity voltage V1 and the pulse of the negative polarity voltage v2. For the output signal of the mixing circuit 10, the reference level may be 0 V.

The level shifter 140 receives a three-step signal from the mixing circuit 10 and outputs a three-step signal with increased voltage. The level shifter 140 shifts the voltages of the input signals MOUT1 and MOUT2 received from the mixing circuit 10 and outputs first and second output signals OUT1 and OUT2 for controlling the display panel driving circuits 110, 112, and 120.

Each of the output signals MOUT1 and MOUT2 is generated as a three-step signal having a three-step voltage. In the first and second output signals OUT1 and OUT2, the positive polarity voltage +V may be a voltage higher than the high voltage (=+3.3 V) of the input signals MOUT1 and MOUT2, for example, the gate high voltage VGH. The negative polarity voltage −V may be a voltage lower than the low voltage (=−3 V) of the input signals MOUT1 and MOUT2, for example, the gate low voltage VGL. The negative polarity voltage −V may be selected from among voltages ranging from VGL to −VGH and may vary depending on the operating characteristics of the display panel driving circuit.

Referring to FIG. 11, a mixing circuit 11 receives first to third input signals IN1, IN2, and IN3 from the signal generation unit 131, inverts the received input signals IN1, IN2, and IN3, and outputs first to third output signals MOUT1, MOUT2, and MOUT3 which have opposite phases. Each of the output signals MOUT1, MOUT2, and MOUT3 is generated as a three-step signal having a three-step voltage.

The output signals MOUT1, MOUT2, MOUT3 of the mixing circuit 11 include pulses generated from the inverted signals of the pulses of the input signals IN1, IN2, and IN3 and thus include the pulse of the positive polarity voltage V1 and the pulse of the negative polarity voltage V2. The input signals IN1, IN2, and IN3 may be output as a two-step pulse of 0 V to 3.3 V. In this case, the positive polarity voltage V1 of the output signals MOUT1, MOUT2, and MOUT3 may be a voltage of +3.3 V, and the negative polarity voltage V2 may be a voltage of −3.3 V. In the first and second output signals MOUT1 and MOUT2, a reference level section is present between the pulse of the positive polarity voltage V1 and the pulse of the negative polarity voltage v2.

The level shifter 140 receives a three-step signal from the mixing circuit 11 and outputs a three-step signal with increased voltage. The level shifter 140 shifts the voltages of the input signals MOUT1, MOUT2, and MOUT3 received from the mixing circuit 11 and outputs output signals OUT1, OUT2, and OUT3 for controlling the display panel driving circuits 110, 112, and 120. Each of the output signals OUT1, OUT2, and OUT3 is generated as a three-step signal having a three-step voltage. In the output signals OUT1, OUT2, and OUT3, the positive polarity voltage +V may be a voltage higher than the high voltage (=+3.3 V) of the input signals MOUT1 and MOUT2, for example, the gate high voltage VGH. The negative polarity voltage −V may be a voltage lower than the low voltage (=−3 V) of the input signals MOUT1 and MOUT2, for example, the gate low voltage VGL. The negative polarity voltage −V may be selected from among voltages ranging from VGL to −VGH and may vary depending on the operating characteristics of the display panel driving circuit.

Figure 12:
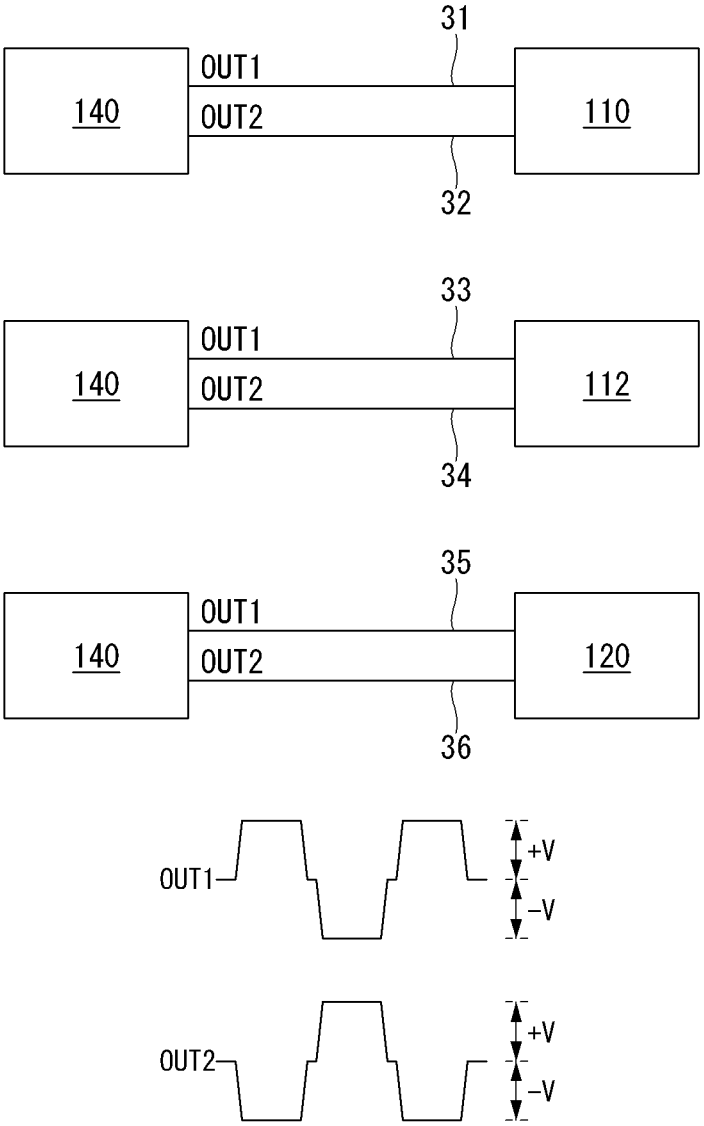
FIG. 12 is a diagram showing signal lines between the level shifter and a display panel driving circuit.

FIG. 12 is a diagram showing signal lines between the level shifter and the display panel driving circuit.

Referring to FIG. 12, the output signals OUT1 and OUT2 of the level shifter 140 may be applied to at least one of the display panel driving circuits 110, 112, and 120 through signal lines 31 to 36 to control the display panel driving circuits 110, 112, and 120.

The three-step signals applied to the neighboring signal lines 31 to 36 may be signals with opposite phases. Accordingly, it is possible to minimize or reduce EMI and noise in the signal lines 31 to 36 due to a field cancelation effect. Also, it is possible to alleviate the accumulation of gate bias stress of transistors, and it is also possible for transistors to recover from the stress.

Figure 13:
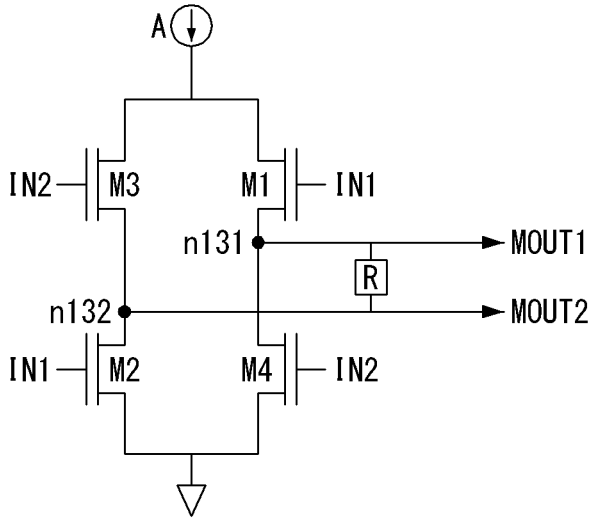
FIGS. 13 and 14 are diagrams showing operation of the mixing circuit.
Figure 13:
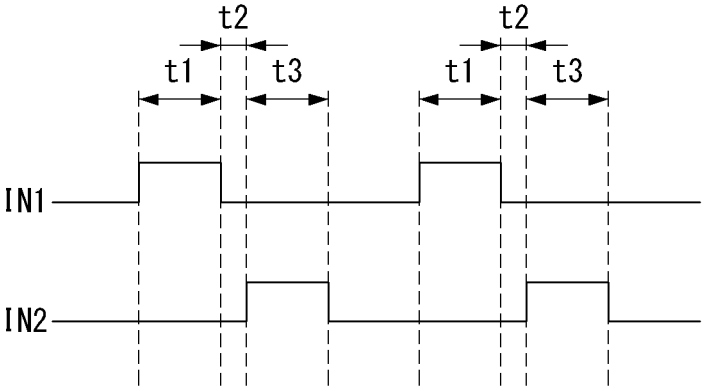
Figure 14:
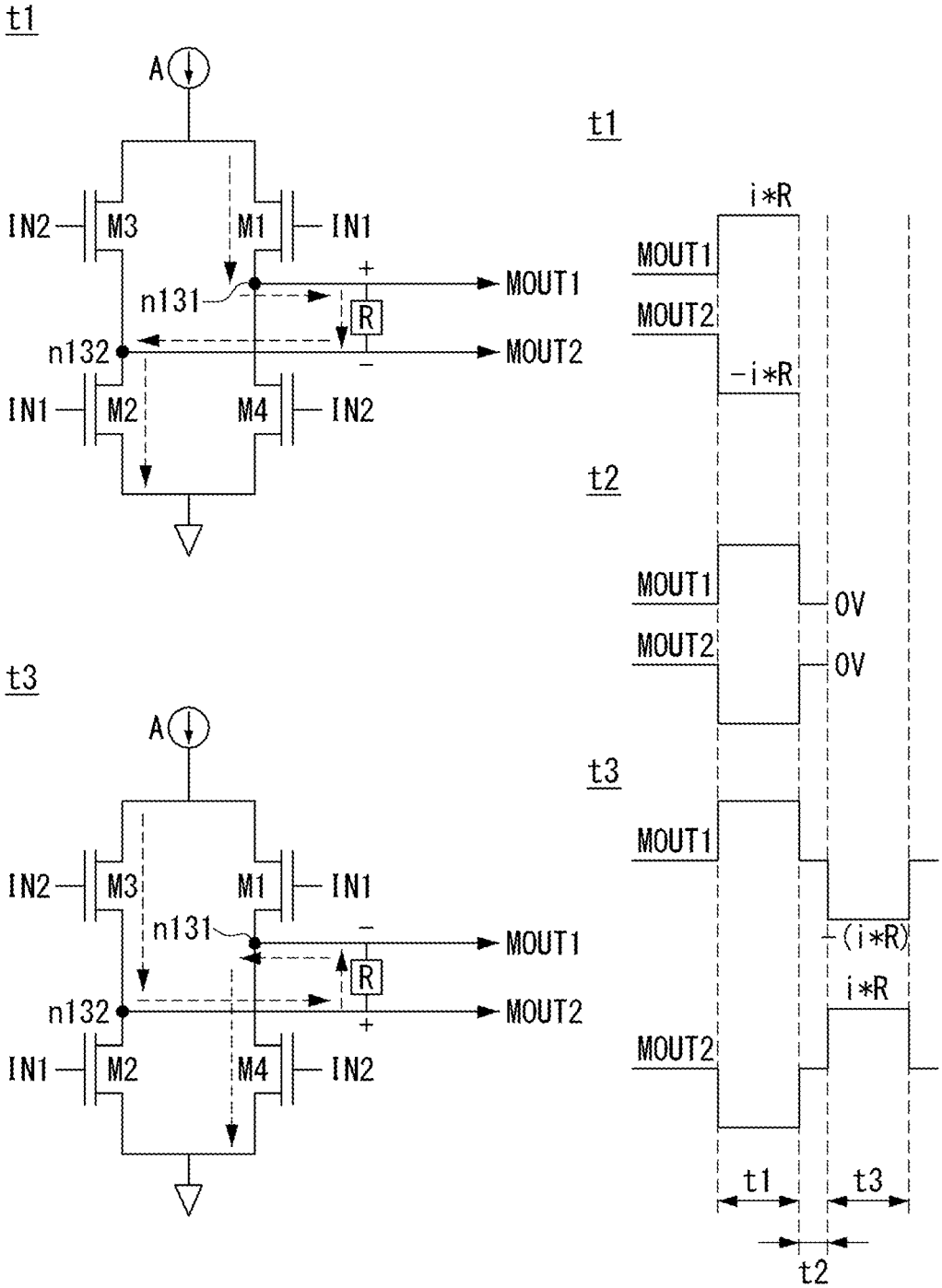

FIGS. 13 and 14 are diagrams showing operation of the mixing circuit 10 or 11

Referring to FIG. 13, the mixing circuit 10 or 11 includes a constant current source A and first to fourth switch elements M1 to M4. The switch elements M1 to M4 may be implemented as transistors. A resistor R is connected between first and second output nodes n131 and n132 of the mixing circuit 10 or 11.

The first and second switch elements M1 and M2 output a non-inverted signal and an inverted signal of the first input signal IN1 through the first and second output nodes n131 and n132. The non-inverted signal of the first input signal IN1 is supplied to the first signal line 31 through the first output node n131. The inverted signal of the first input signal IN1 is supplied to the second signal line 32 through the second output node n132.

The first switch element M1 is turned on in response to the high voltage (=3.3 V) of the first input signal IN1 to connect the constant current source A to the first output node n131. The first switch element M1 includes a gate to which the first input signal IN1 is input, a first electrode connected to the constant current source A, and a second electrode connected to the first output node n131. The second switch element M2 is turned on in response to the high voltage (=3.3 V) of the first input signal IN1 to connect the second output node n132 to a ground voltage source GND. The second switch element M2 includes a gate to which the first input signal IN1 is input, a first electrode connected to the second output node n132, and a second electrode connected to the ground voltage source GND.

The third and fourth switch elements M3 and M4 output a non-inverted signal and an inverted signal of the second input signal IN2 through the first and second output nodes n131 and n132. The non-inverted signal of the second input signal IN2 is supplied to the second signal line 32 through the second output node n132. The inverted signal of the second input signal IN2 is supplied to the first signal line 31 through the first output node n131.

The third switch element M3 is turned on in response to the high voltage (=3.3 V) of the second input signal IN2 to connect the constant current source A to the second output node n132. The third switch element M3 includes a gate to which the second input signal IN2 is input, a first electrode connected to the constant current source A, and a second electrode connected to the second output node n132. The fourth switch element M4 is turned on in response to the high voltage (=3.3 V) of the second input signal IN2 to connect the first output node n131 to the ground voltage source GND. The fourth switch element M4 is a gate to which the second input signal IN2 is input, a first electrode connected to the first output node n131, and a second electrode connected to the ground voltage source GND.

When the input signals IN1 and IN2 as in the example of FIG. 13 are input to the mixing circuit 10 or 11, the electric current path and output signal of the mixing circuit 10 or 11 at t1, t2, and t3 on the time axis are as shown in FIG. 14. The following description assumes that the input signals IN1 and IN2 satisfy IN1=High and IN2=Low at t1 and IN1=Low and IN2=Low at t2. Also, the following description assumes that the input signals IN1 and IN2 satisfy IN1=Low and IN2=High at t3.

Referring to FIG. 14, the first input signal IN1 has the high voltage High at t1. At t1, the first and second switch elements M1 and M2 are turned on to output a non-inverted signal of the first input signal IN1 to the first output node n131. The voltage V of the non-inverted signal satisfies V=I*R when the current of the constant current source A is I and the resistance of the resistor R is R. At the same time, the inverted signal of the first input signal IN1 is output to the second output node n132. The voltage V of the inverted signal satisfies V=−I*R.

At t2, the first and second input signals IN1 and IN2 have the low voltage Low. In this case, the first to fourth switch elements M1 to M4 are turned off, and the voltages of the first and second output nodes n131 and n132 are the low voltage Low (=0 V).

At t3, the second input signal IN2 is inverted into the high voltage High. At t3, the third and fourth switch elements M3 and M4 are turned on to output the inverted signal of the second input signal IN2 to the first output node n131. The voltage V of the inverted signal satisfies V=−I*R. At the same time, the non-inverted signal of the first input signal IN1 is output to the second output node n132. The voltage V of the non-inverted signal satisfies V=I*R.

Figure 15:
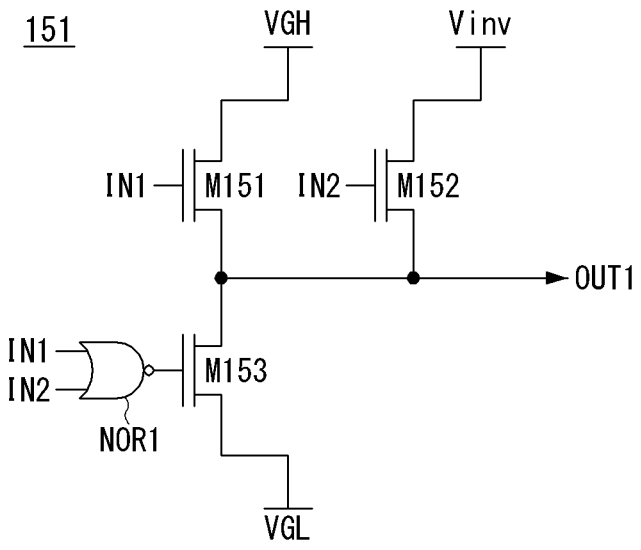
FIG. 15 is a circuit diagram specifically showing an example of a level shifter that receives a two-step signal and outputs a three-step signal.
Figure 15:
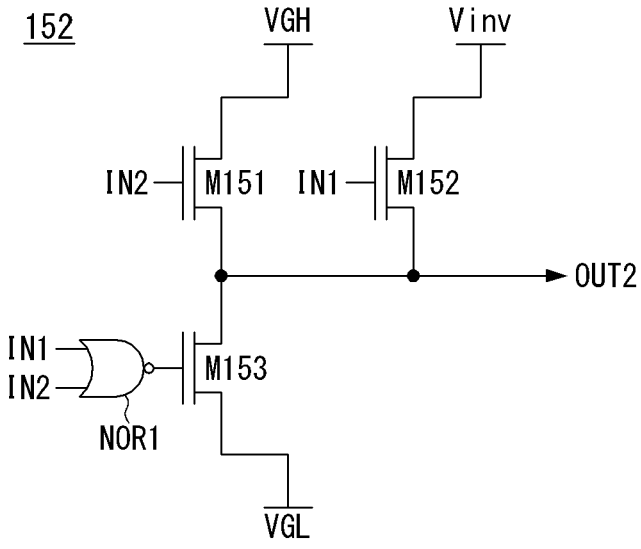

FIG. 15 is a circuit diagram specifically showing an example of the level shifter 140 that receives a two-step signal and outputs a three-step signal.

Referring to FIG. 15, the level shifter 140 includes a first level shifter 151 configured to output a first three-step signal OUT1 through a first output node and a second level shifter 152 configured to output a second three-step signal OUT2 through a second output node. The first output node may be connected to the first signal line 31, and the second output node may be connected to the second signal line 32.

The first level shifter 151 outputs the gate high voltage VGH in response to the first input signal IN1 and outputs an inverted voltage Vinv in response to the second input signal IN2. The second level shifter 152 outputs the gate high voltage VGH in response to the second input signal IN2 and outputs the inverted voltage Vinv in response to the first input signal IN1.

The inverted voltage Vinv may be a minimal gate low voltage VGL or a negative polarity voltage between the gate low voltage VGL and a maximal negative polarity voltage −Max. The gate high voltage VGH and the gate low voltage VGL may satisfy VGH=22 V and VGL=−3 V, but the present disclosure is not limited thereto. The maximal negative polarity voltage −Max may be set to be −(VGH−VGL) or −VGH, but the present disclosure is not limited thereto.

The first and second input signals IN1 and IN2 of the level shifter 140 are signals with opposite phases. Accordingly, when the first input signal IN1 is a high voltage, the second input signal IN2 is a low voltage. Conversely, when the first input signal IN1 is a low voltage, the second input signal IN2 is a high voltage.

Each of the first and second level shifters 151 and 152 includes first to third switch elements M151, M152, and M153 and NOR gates NOR1 and NOR2. The switch elements M151, M152, and M153 may be implemented as transistors.

When the mixing circuit 10 or 11 is disposed between the signal generation unit 131 and the level shifter 140, the input signal of the level shifter 140 may include three-step signals MOUT1 and MOUT2 which are output from the mixing circuit 10 or 11.

The first switch element M151 is turned on according to the input signal IN1 or IN2 to output the gate high voltage VGH and shift the high voltage (=3.3 V) of the input signal IN1 or IN2 to the gate high voltage VGH (=22 V). The first switch element M151 includes a gate to which the input signal IN1 or IN2 is applied, a first electrode to which the gate high voltage VGH is applied, and a second electrode connected to an output node. For the first level shifter 151, the first input signal IN1 is applied to the gate of the first switch element M151. For the second level shifter 152, the second input signal IN2 is applied to the gate of the first switch element M151.

The second switch element M152 is turned on according to the input signal IN1 or IN2 to output the inverted voltage Vinv. As described above, the inverted voltage Vinv may be a negative polarity voltage lower than a reference level voltage, for example, the minimal gate low voltage VGL, or a negative polarity voltage between the gate low voltage VGL and the maximal negative polarity voltage −Max. The second switch element M152 includes a gate to which the input signal IN1 or IN2 is applied, a first electrode to which the inverted voltage Vinv is applied, and a second electrode connected to an output node. For the first level shifter 151, the second input signal IN2 is applied to the gate of the second switch element M152. For the second level shifter 152, the first input signal IN1 is applied to the gate of the second switch element M152.

The NOR gates NOR1 and NOR2 output the NOR operation result of the two input signals. When the output signals of the NOR gates NOR1 and NOR2 are high voltages, the third switch element M153 is turned on to supply the gate low voltage VGL to the output node. The third switch element M153 includes a gate to which the output signals of the NOR gates NOR1 and NOR2 are applied, a first electrode connected to the output node, and a second electrode to which the gate low voltage VGL is applied.

When the demultiplexer 112 is a 1:3 demultiplexer or when a shift clock CLK input to the gate driving unit 120 is a three-phase clock, the signal generation unit 131 may output first to third input signals IN1, IN2, and IN3 with sequentially shifted phases.

Figure 16:
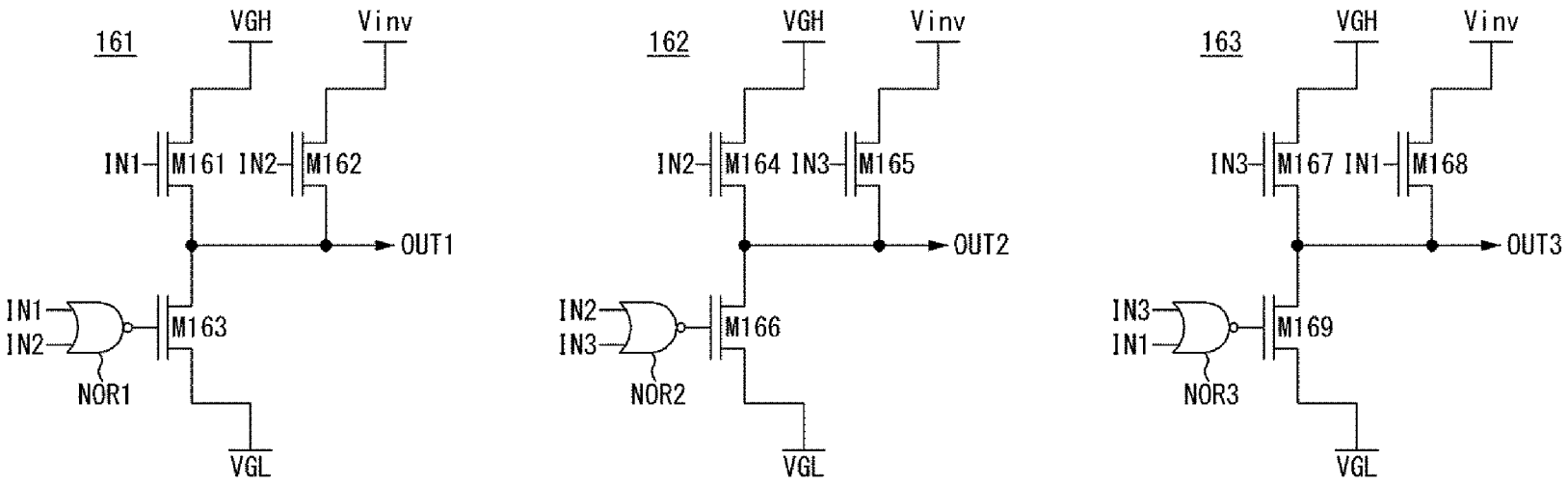
FIG. 16 is a circuit diagram specifically showing an example of a cascade-type level shifter that receives first to third input signals.

FIG. 16 is a circuit diagram specifically showing an example of a cascade-type level shifter 140 that receives first to third input signals. For the same elements as those of the embodiment shown in FIG. 15, a description of their connection relationship will be omitted in FIG. 16.

Referring to FIG. 16, the level shifter 140 includes a first level shifter 161 configured to receive the first and second input signals IN1 and IN2 and output a first three-step signal OUT1 through a first output node, a second level shifter 162 configured to receive second and third input signals IN2 and IN3 and output a second three-step signal OUT2 through a second output node, and a third level shifter 163 configured to receive the first and third input signals IN1 and IN3 and output a third three-step signal OUT3 through a third output node.

The phases of the first to third input signals IN1, IN2, and IN3 of the level shifter 140 may be sequentially shifted.

The first level shifter 161 outputs the gate high voltage VGH in response to the first input signal IN1 and outputs the inverted voltage Vinv in response to the second input signal IN2. The second level shifter 162 outputs the gate high voltage VGH in response to the second input signal IN2 and outputs the inverted voltage Vinv in response to the third input signal IN3. The third level shifter 163 outputs the gate high voltage VGH in response to the third input signal IN3 and outputs the inverted voltage Vinv in response to the first input signal IN1.

The first to third level shifters 161, 162, and 163 include first switch elements M161, M164, M167, second switch elements M162, M165, M168, third switch elements M163, M166, and M169, and NOR gates NOR1, NOR2, and NOR3, respectively. The switch elements M161, M162, and M163 may be implemented as transistors.

When the mixing circuit 10 or 11 is disposed between the signal generation unit 131 and the level shifter 140, the input signals IN1, IN2, and IN3 of the level shifter 140 may be three-step signals MOUT1 and MOUT2 which are output from the mixing circuit 10 or 11.

The first switch elements M161, M164, and M167 are turned on according to the input signals IN1, IN2, and IN3 to output the gate high voltage VGH and shift the high voltage (=3.3 V) of the input signals IN1, IN2, and IN3 to the gate high voltage VGH (=22 V), respectively. For the first level shifter 151, the first input signal IN1 is applied to the gate of the first switch element M161. For the second level shifter 162, the second input signal IN2 is applied to the gate of the first switch element M164. For the third level shifter 163, the third input signal IN3 is applied to the gate of the first switch element M167.

The second switch elements M162, M165, and M168 are turned on according to the input signals IN2, IN1, and IN3 to output the inverted voltage Vinv, and thus output the inverted voltage Vinv in response to the input signal IN2, IN1, and IN3, respectively. For the first level shifter 161, the second input signal IN2 is applied to the gate of the second switch element M162. For the second level shifter 162, the third input signal IN3 is applied to the gate of the second switch element M165. For the third level shifter 163, the first input signal IN1 is applied to the gate of the second switch element M168.

The NOR gates NOR1, NOR2, and NOR3 the NOR operation result of the two input signals. For the first level shifter 161, the first and second input signals IN1 and IN2 are input to the first NOR gate NOR1. For the first level shifter 162, the second and third input signals IN2 and IN3 are input to the second NOR gate NOR2. For the third level shifter 163, the first and third input signals IN1 and IN3 are input to the third NOR gate NOR3.

When the output signals of the NOR gates NOR1, NOR2, and NOR3 are high voltages, the third switch elements M163, M166, and M169 are turned on to supply the gate low voltage VGL to output nodes. The third switch elements M163, M166, and M169 include gates to which the output signals of the NOR gates NOR1, NOR2, and NOR3 are applied, first electrodes connected to the output nodes, and second electrodes to which the gate low voltage VGL is applied, respectively.

The mixing circuit 10 or 11 and the level shifter 140 may receive two or more input signals and generate a three-step signal. The level shifter 140 may output a three-step signal with a voltage obtained by increasing the voltage of the input signal received from the signal generation unit 131 or the mixing circuit 10 or 11. Also, the level shifter 140 may receive the output signal of the signal generation unit 131 and the output signal of the mixing circuit 10 or 11 and generate a three-step signal with a voltage obtained by increasing the voltage of the received signal, as in an example of FIG. 27.

Figure 17:
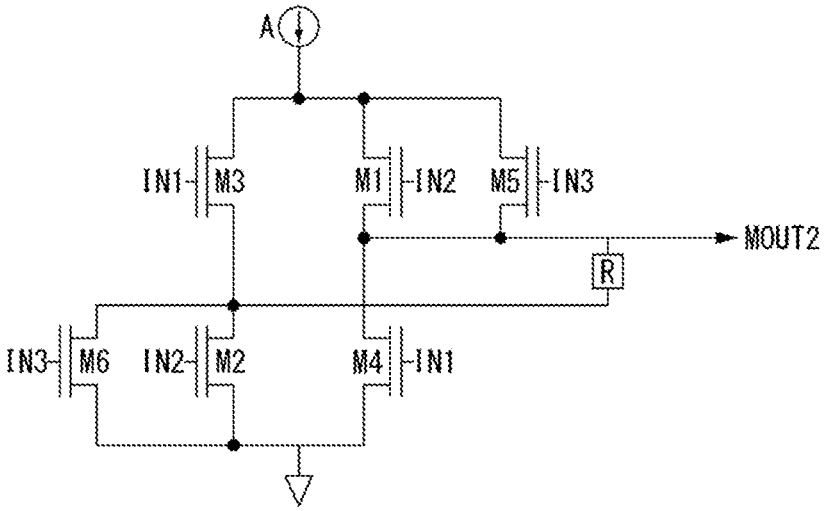
FIG. 17 is a circuit diagram showing an example of a mixing circuit that receives first to third input signals and outputs a three-step signal.

FIG. 17 is a circuit diagram specifically showing an example of a mixing circuit that receives first to third input signals and outputs a three-step signal.

Referring to FIG. 17, the mixing circuit 10 or 11 receives the first input signal IN1 or the third input signal IN3 in addition to the second input signal IN2 and outputs a second three-step signal MOUT2.

The first switch element M1 is turned on in response to the high voltage (=3.3 V) of the second input signal IN2 to connect the constant current source A to the first output node. The first switch element M1 includes a gate to which the second input signal IN2 is input, a first electrode connected to the constant current source A, and a second electrode connected to the first output node. The second switch element M2 is turned on in response to the high voltage (=3.3 V) of the second input signal IN2 to connect the second output node to the ground voltage source GND. The second switch element M2 includes a gate to which the second input signal IN2 is input, a first electrode connected to the second output node, and a second electrode connected to the ground voltage source GND.

The third switch element M3 is turned on in response to the high voltage (=3.3 V) of the first input signal IN1 to connect the constant current source A to the second output node. The third switch element M3 includes a gate to which the first input signal IN1 is input, a first electrode connected to the constant current source A, and a second electrode connected to the second output node. The fourth switch element M4 is turned on in response to the high voltage (=3.3 V) of the first input signal IN1 to connect the first output node to the ground voltage source GND. The fourth switch element M4 includes a gate to which the first input signal IN1 is input, a first electrode connected to the first output node, and a second electrode connected to the ground voltage source GND.

The fifth switch element M5 is turned on in response to the high voltage (=3.3 V) of the third input signal IN3 to connect the constant current source A to the first output node. The fifth switch element M5 includes a gate to which the third input signal IN3 is input, a first electrode connected to the constant current source A, and a second electrode connected to the first output node. The sixth switch element M6 is turned on in response to the high voltage (=3.3 V) of the third input signal IN3 to connect the second output node to the ground voltage source GND. The sixth switch element M6 includes a gate to which the third input signal IN3 is input, a first electrode connected to the second output node, and a second electrode connected to the ground voltage source GND.

Figure 18:
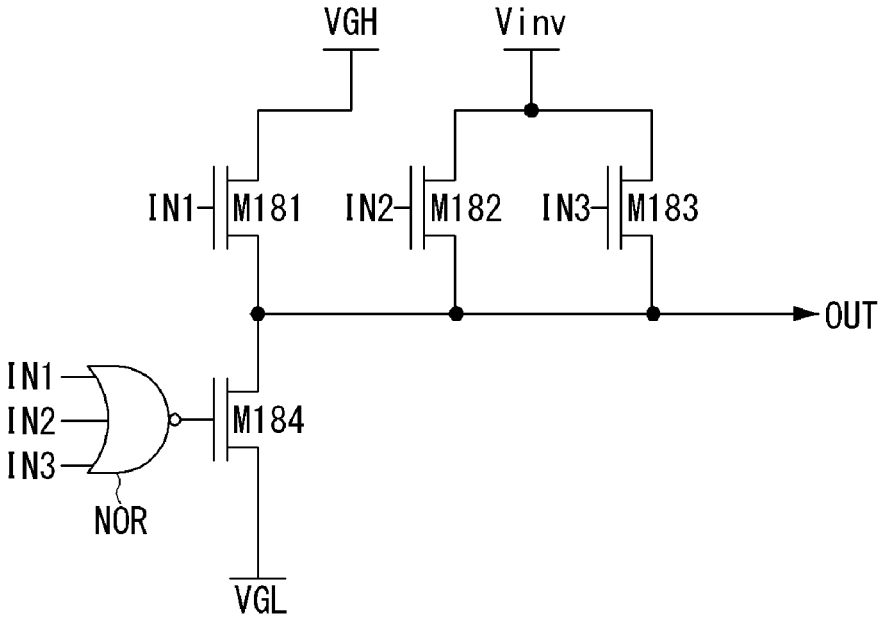
FIG. 18 is a circuit diagram showing an example of a level shifter that receives first to third input signals and outputs a three-step signal.

FIG. 18 is a circuit diagram showing an example of a level shifter that receives first to third input signals and outputs a three-step signal.

Referring to FIG. 18, the level shifter 140 receives first to third input signals IN1, IN2, and IN3. The phases of the first to third input signals IN1, IN2, and IN3 may be sequentially shifted by the shift register of the signal generation unit 131. At least one of the first to third input signals IN1, IN2, and IN3 may be a three-step signal input from the mixing circuit 10 or 11.

The level shifter 140 includes first to fourth switch elements M181 to M184 and a NOR gate NOR. The switch elements M181 to M184 may be implemented as transistors.

The first switch element M181 is turned on according to the first input signal IN1 to output the gate high voltage VGH and shift the high voltage (=3.3 V) of the input signal IN1 or IN2 to the gate high voltage VGH (=22 V). The first switch element M181 includes a gate to which the first input signal IN1 is applied, a first electrode to which the gate high voltage VGH is applied, and a second electrode connected to an output node.

The second switch element M182 is turned on according to the second input signal IN2 to output the inverted voltage Vinv. The inverted voltage Vinv may be a negative polarity voltage lower than a reference level voltage, for example, the minimal gate low voltage VGL or a negative polarity voltage between the gate low voltage VGL and the maximal negative polarity voltage −Max. The second switch element M182 includes a gate to which the second input signal IN2 is applied, a first electrode to which the inverted voltage Vinv is applied, and a second electrode connected to the output node.

The third switch element M183 is turned on according to the third input signal IN3 to output the inverted voltage Vinv. The third switch element M183 includes a gate to which the third input signal IN3 is applied, a first electrode to which the inverted voltage Vinv is applied, and a second electrode connected to the output node.

The NOR gate NOR outputs the NOR operation result of the three input signals. When the output signal of the NOR gate NOR is a high voltage, the fourth switch element M184 is turned on to supply the gate low voltage VGL to the output node. The third switch element M184 includes a gate to which the output signal of the NOR gate NOR is applied, a first electrode connected to the output node, and a second electrode to which the gate low voltage VGL is applied.

Figure 19:
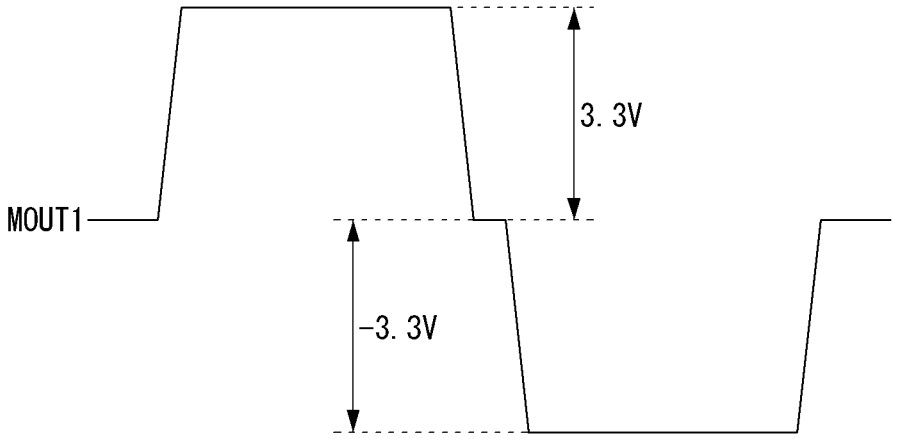
FIG. 19 is a waveform diagram showing three-step signals output from the mixing circuit and the level shifter.
Figure 19:
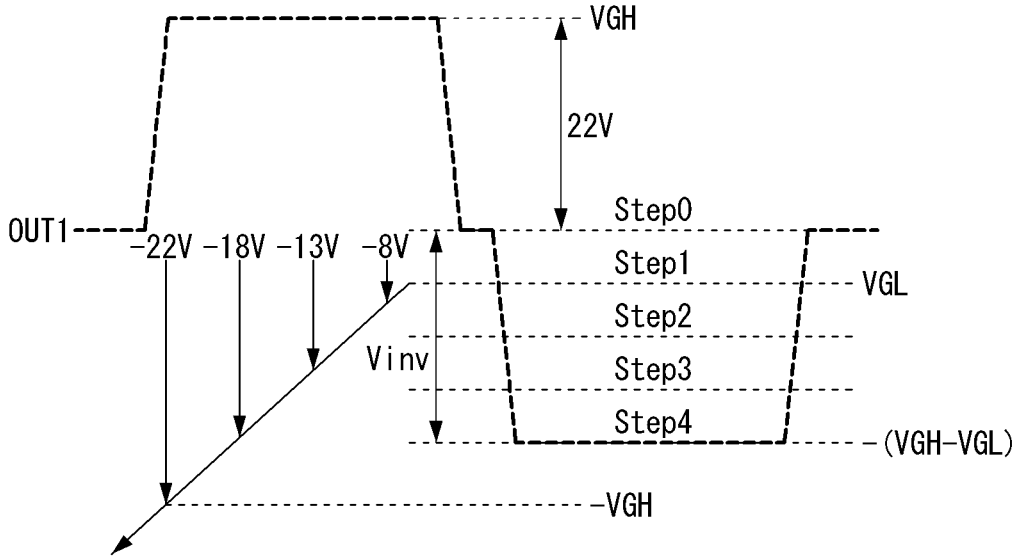

FIG. 19 is a waveform diagram showing three-step signals output from the mixing circuit 10 or 11 and the level shifter 140.

Referring to FIG. 19, the three-step signal output from the mixing circuit 10 or 11 is generated to have 3.3 V, 0 V, and −3.3 V. In comparison, the three-step signal output from the level shifter 140 is generated to have the gate high voltage VGH (=22 V), the gate low voltage VGL (=−3 V), and the inverted voltage Vinv. The voltage level of the inverted voltage Vinv may vary depending on the transistor characteristics. For example, the inverted voltage Vinv shown in FIG. 19 may vary among (or may be selected from among) voltages ranging from step 1 to −VGH.

Figure 20:
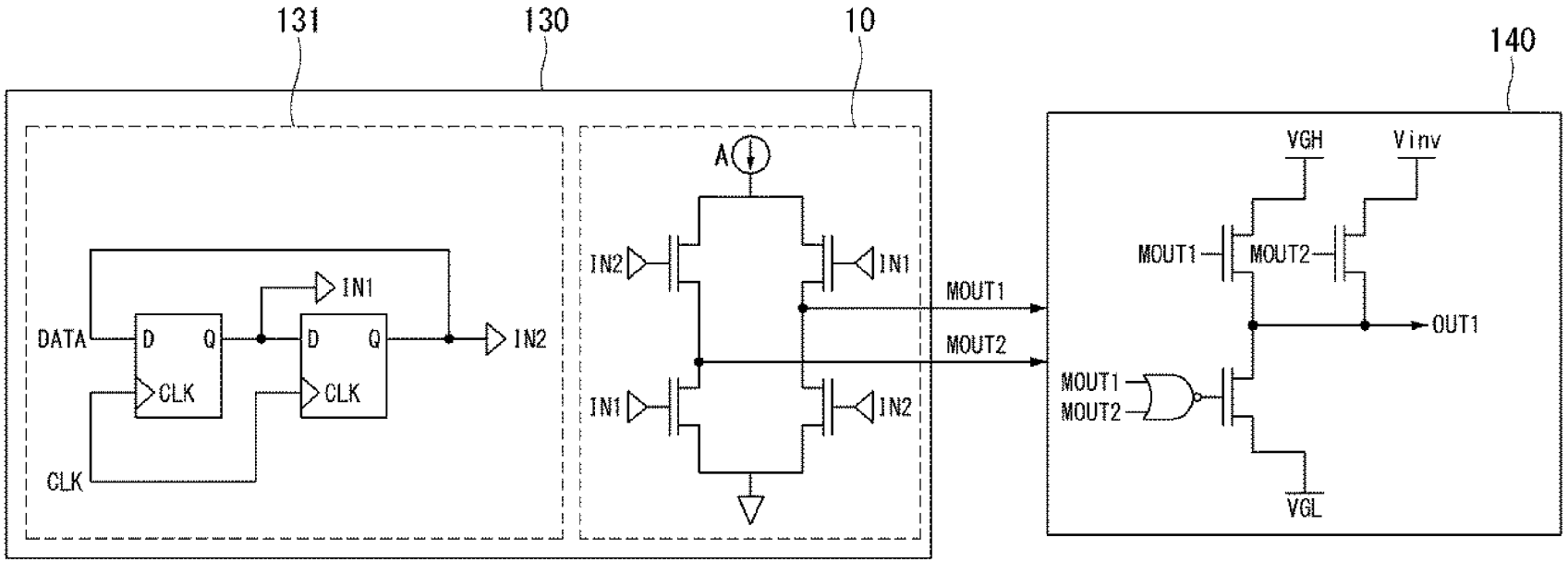
FIG. 20 is a circuit diagram showing an example in which the mixing circuit shown in FIG. 13 is connected to the signal generation unit and the level shifter.
Figure 21:
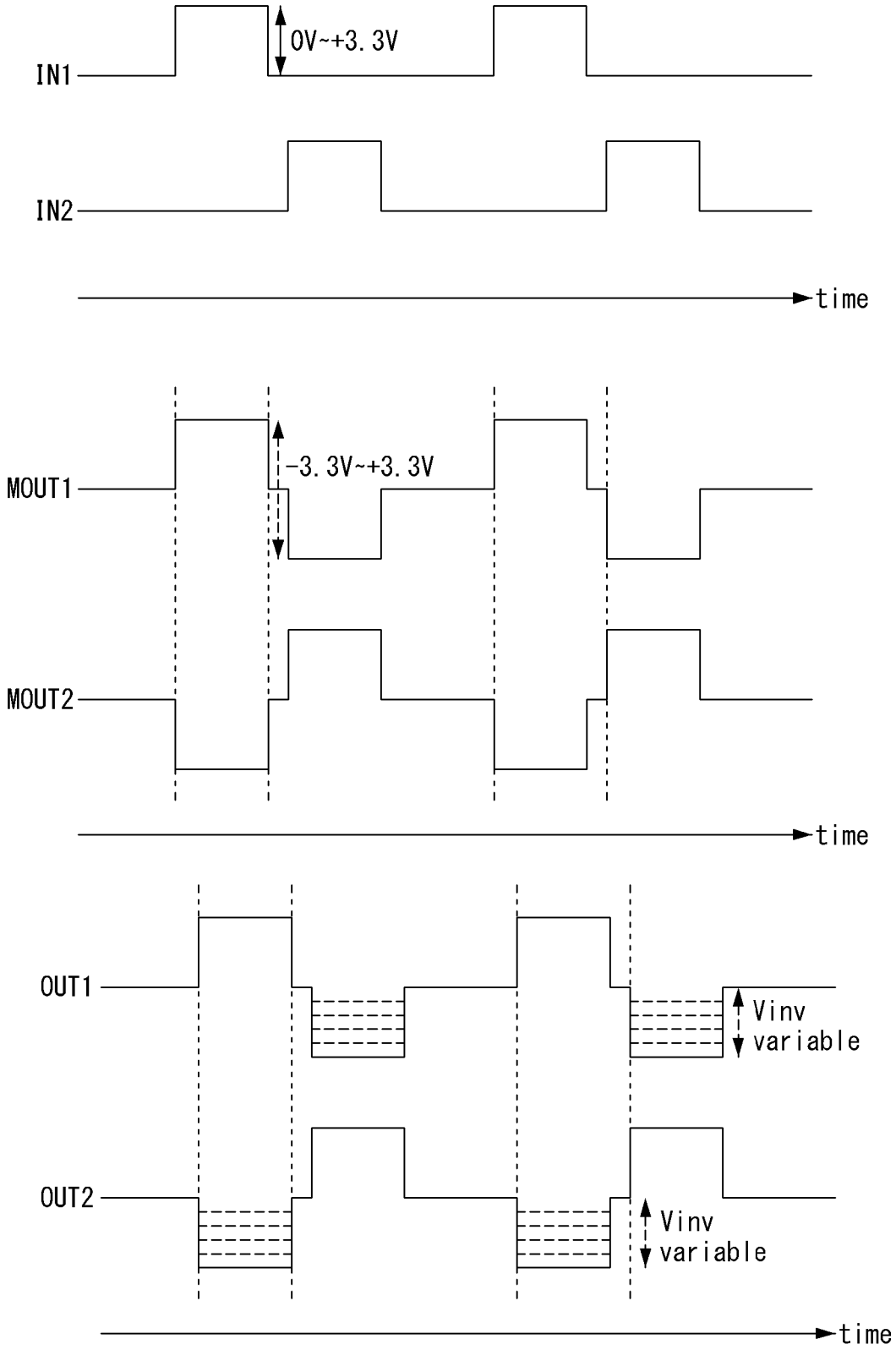
FIG. 21 is a waveform diagram showing input signals, output signals of the mixing circuit, and output signals of the level shifter which are shown in FIG. 20.

FIG. 20 is a circuit diagram showing an example in which the mixing circuit shown in FIG. 13 is connected to the signal generation unit and the level shifter. FIG. 21 is a waveform diagram showing the input signals IN1 and IN2, the output signals MOUT1 and MOUT2 of the mixing circuit 10, and the output signals OUT1 and OUT2 of the level shifter which are shown in FIG. 20.

Referring to FIGS. 20 and 21, the signal generation unit 131 may include a shifter register in which D flip-flops are connected in cascade. The shift register may generate input signals IN1 and IN2 with sequentially shifted phases. The input signals IN1 and IN2 may transition between 0 V and 3.3 V.

The mixing circuit 10 may be connected between the signal generation unit 131 and the level shifter 140. After outputting a non-inverted signal and an inverted signal of the first input signal IN1 received from the signal generation unit 131, the mixing circuit 10 may output a non-inverted signal and an inverted signal of the second input signal IN2 and output three-step signals MOUT1 and MOUT2. The output signals MOUT1 and MOUT2 of the mixing circuit 10 are three-step signals having a reference level voltage of 0 V, a positive polarity voltage of 3.3 V, and a negative polarity voltage of −3.3 V.

The level shifter 140 shifts the voltage of the input signal received from the signal generation unit 131 or the mixing circuit 10 and outputs a three-step signal with a voltage higher than that of the input signal. When the level shifter 140 receives an input signal from the mixing circuit 10, the level shifter 140 may convert the positive polarity voltage of 3.3 V into the gate high voltage VGH (=22 V), convert the reference level voltage of 0 V into the gate low voltage VGL (=−3 V), and convert the negative polarity voltage of −3.3 V into the inverted voltage Vinv.

Figure 22:
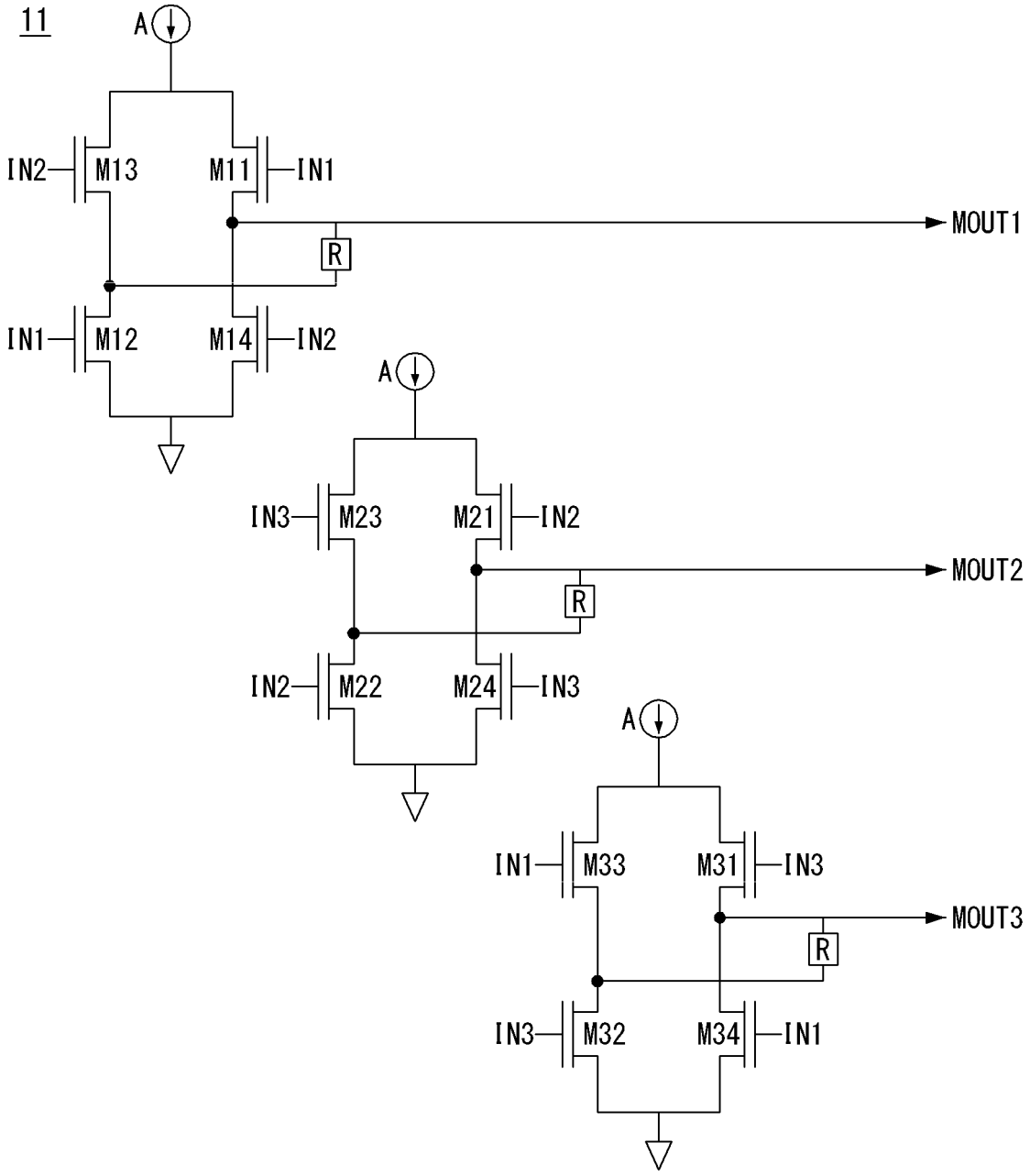
FIG. 22 is a circuit diagram showing an example of a cascade-type mixing circuit.
Figure 23:
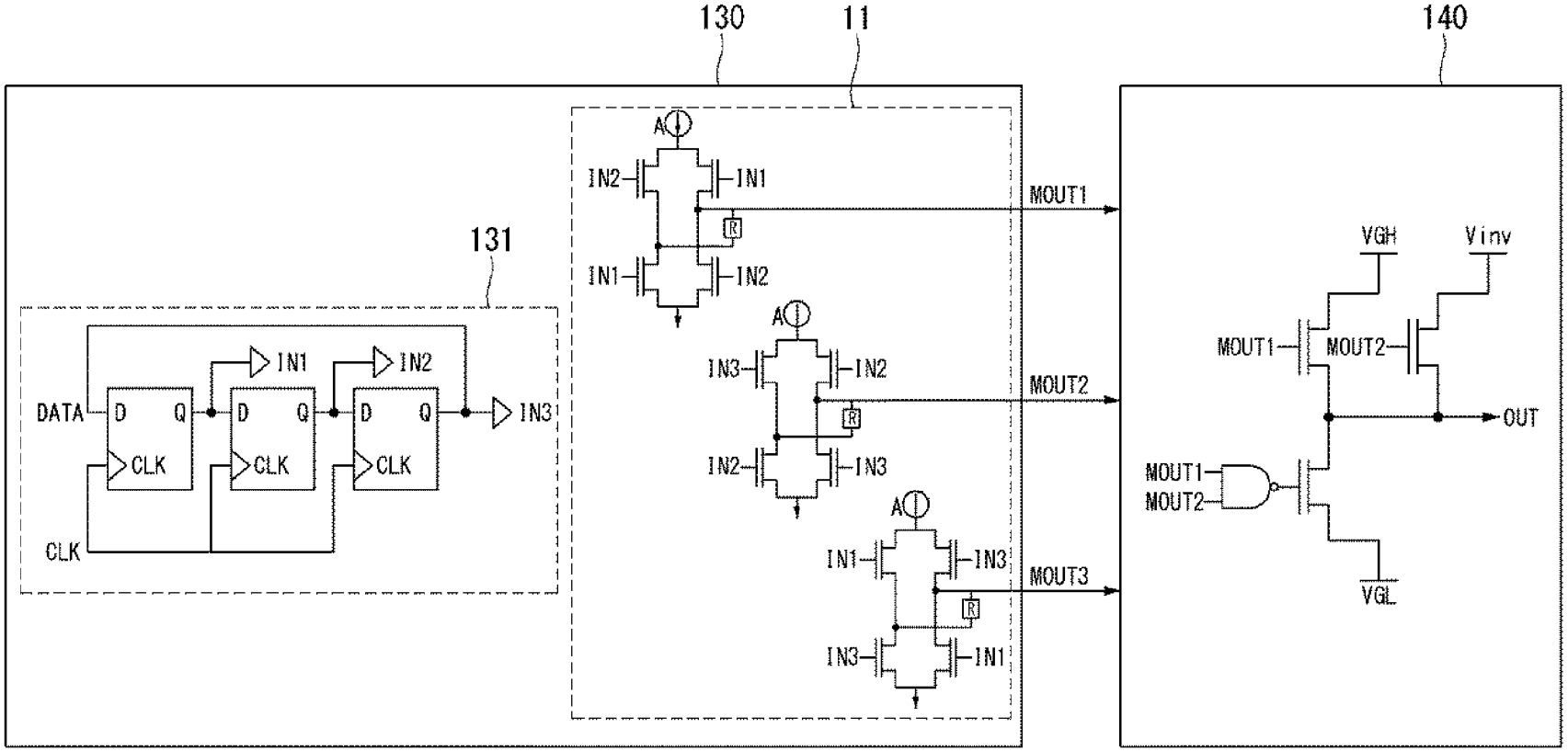
FIG. 23 is a circuit diagram showing an example in which the mixing circuit shown in FIG. 22 is connected between the signal generation unit and the level shifter.
Figure 24:
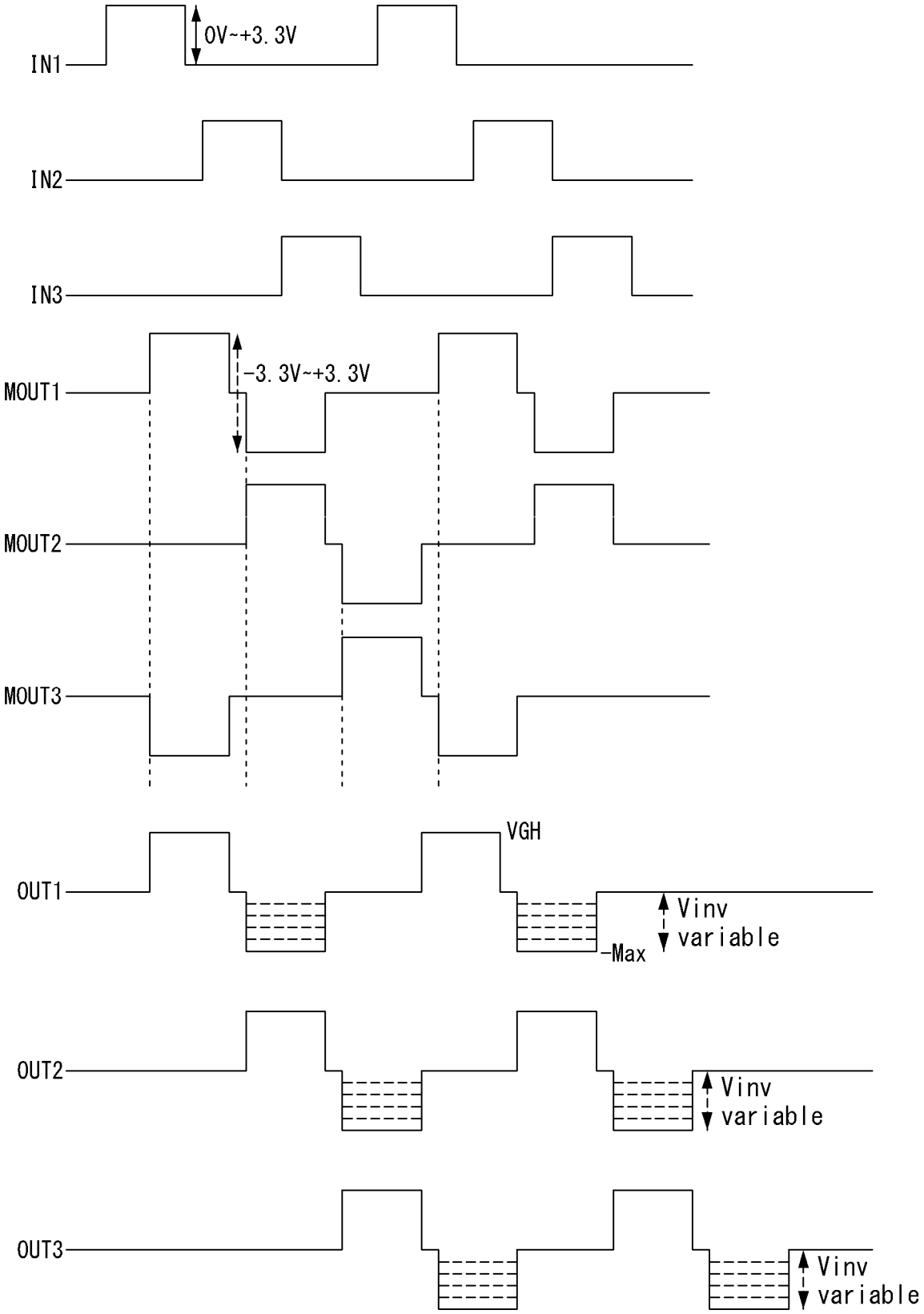
FIG. 24 is a waveform diagram showing an input signal, an output signal of the mixing circuit, and an output signal of the level shifter which are shown in FIG. 23.

FIG. 22 is a circuit diagram showing an example of a cascade-type mixing circuit 11. FIG. 23 is a circuit diagram showing an example in which the mixing circuit shown in FIG. 22 is connected between the signal generation unit and the level shifter. FIG. 24 is a waveform diagram showing the input signals IN1 and IN2, the output signals MOUT1, MOUT2, and MOUT3 of the mixing circuit 11, and the output signals OUT1, OUT2, and OUT3 of the level shifter 140 which are shown in FIG. 23.

Referring to FIGS. 22 and 23, the signal generation unit 131 may generate input signals IN1, IN2, and IN3 with phases that are sequentially shifted using a shift register. The input signals IN1, IN2, and IN3 may transition between 0 V and 3.3 V.

The mixing circuit 11 may be connected between the signal generation unit 131 and the level shifter 140. The mixing circuit 11 may output three-step signals MOUT1, MOUT2, and MOUT3 by alternately outputting non-inverted signals and inverted signals of the input signals IN1, IN2, and IN3 received from the signal generation unit 131. The output signals MOUT1, MOUT2, and MOUT3 of the mixing circuit 11 are three-step signals having a reference level voltage of 0 V, a positive polarity voltage of 3.3 V, and a negative polarity voltage of −3.3 V.

The mixing circuit 11 includes a first mixing circuit configured to receive the first and second input signals IN1 and IN2 and alternately output non-inverted signals and inverted signals of the first and second input signals IN1 and IN2 to output the first three-step signal MOUT1, a second mixing circuit configured to receive the second and third input signals IN2 and IN3 and alternately output non-inverted signals and inverted signals of the second and third input signals IN2 and IN3 to output the second three-step signal MOUT2, and a third mixing circuit configured to receive the first and third input signals IN1 and IN3 and alternately output non-inverted signals and inverted signals of the first and third input signals IN1 and IN3 to output the third three-step signal MOUT3.

A resistor R is connected between first and second output nodes of the first mixing circuit. The first output node of the first mixing circuit is connected to the first input node of the level shifter 140 to supply the first three-step signal MOUT1 to the level shifter 140. First and second switch elements M11 and M12 supply the non-inverted signal of the first input signal IN1 to the first output node. Third and fourth switch elements M13 and M14 supply the inverted signal of the second input signal IN2 to the first output node.

A resistor R is connected between first and second output nodes of the second mixing circuit. The first output node of the second mixing circuit is connected to the second input node of the level shifter 140 to supply the second three-step signal MOUT2 to the level shifter 140. In the second mixing circuit, first and second switch elements M21 and M22 supply the non-inverted signal of the second input signal IN2 to the first output node. Third and fourth switch elements M23 and M24 supply the inverted signal of the third input signal IN3 to the first output node.

A resistor R is connected between first and second output nodes of the third mixing circuit. The first output node of the third mixing circuit is connected to the third input node of the level shifter 140 to supply the third three-step signal MOUT3 to the level shifter 140. In the third mixing circuit, first and second switch elements M31 and M32 supply the non-inverted signal of the third input signal IN3 to the first output node. Third and fourth switch elements M33 and M34 supply the inverted signal of the first input signal IN1 to the first output node.

The level shifter 140 shifts the voltage of the input signal received from the signal generation unit 131 or the mixing circuit 11 and outputs a three-step signal with a voltage higher than that of the input signal. When the level shifter 140 receives an input signal from the mixing circuit 11, the level shifter 140 may convert the positive polarity voltage of 3.3 V into the gate high voltage VGH (=22 V), convert the reference level voltage of 0 V into the gate low voltage VGL (=−3 V), and convert the negative polarity voltage of −3.3 V into the inverted voltage Vinv lower than the gate low voltage VGL.

Figure 25:
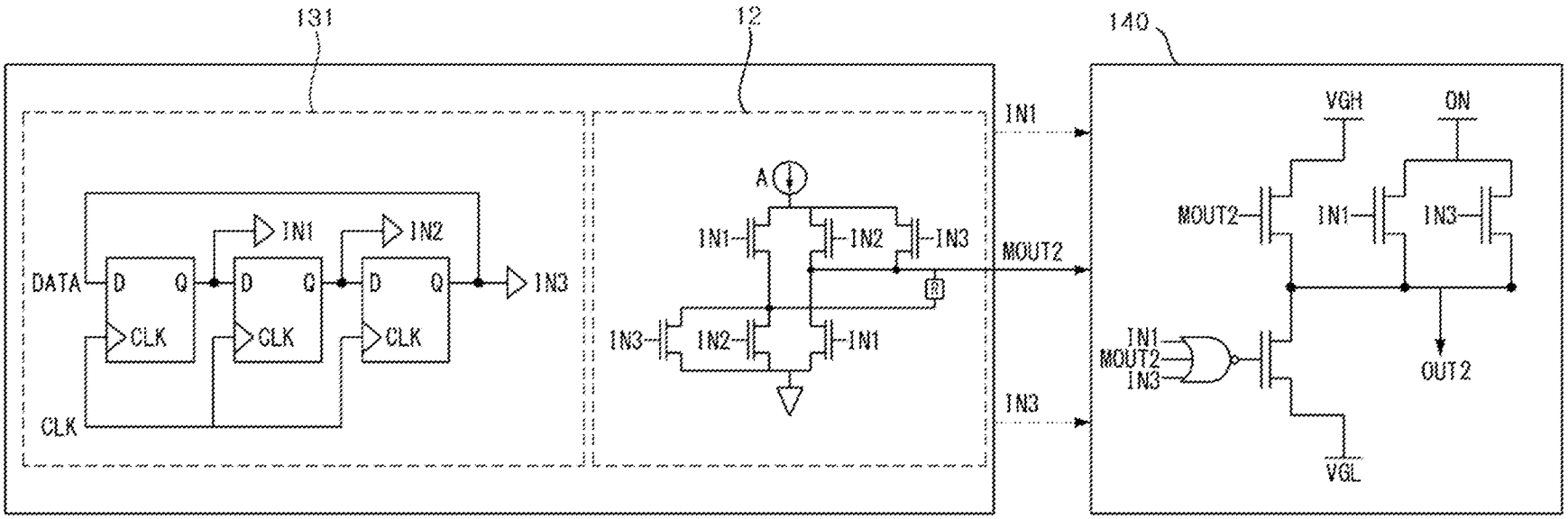
FIG. 25 is a circuit diagram showing an example in which the mixing circuit shown in FIG. 17 and the level shifter shown in FIG. 18 are combined.
Figure 26:
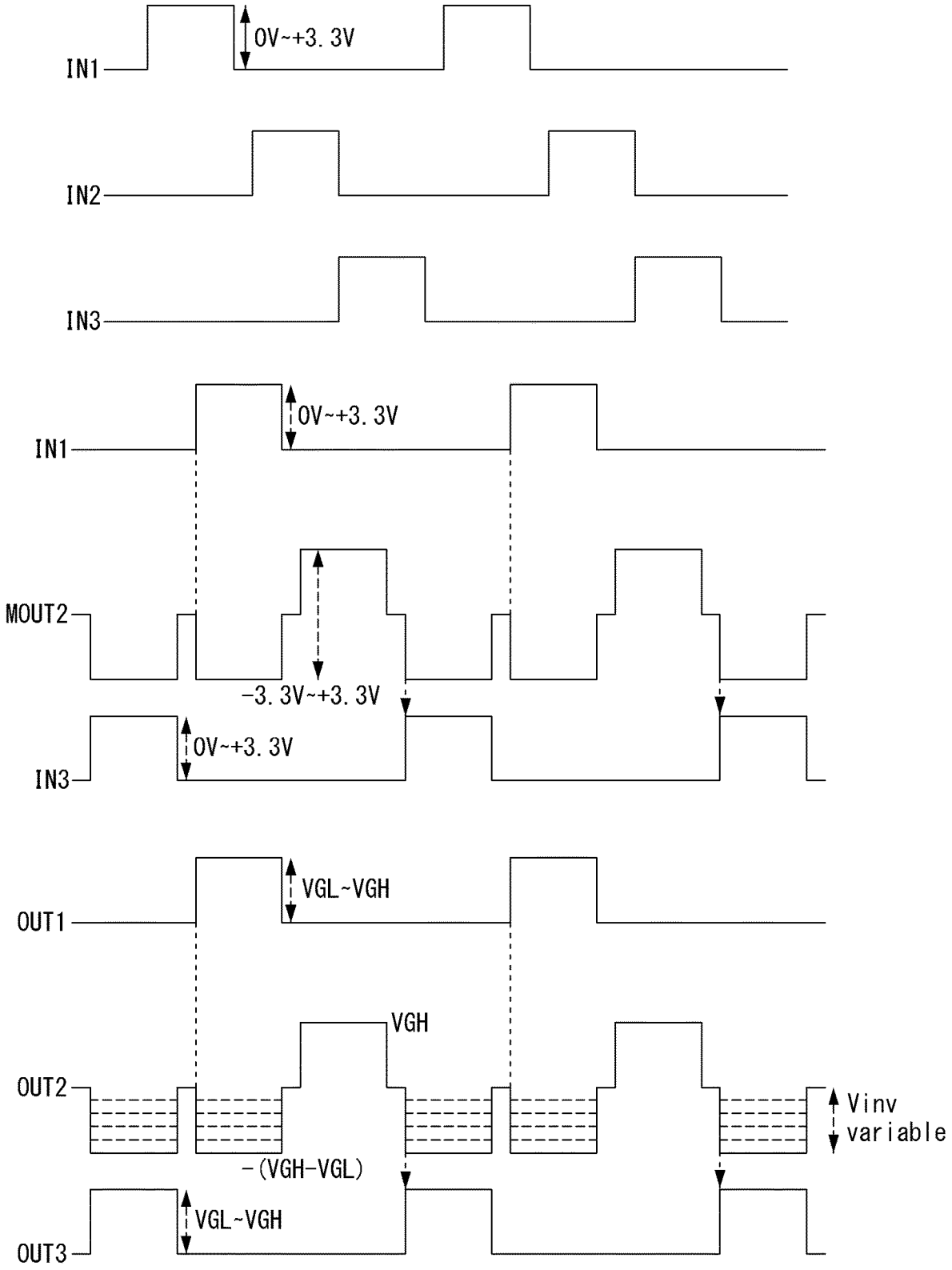
FIG. 26 is a waveform diagram showing an input signal, an output signal of the mixing circuit, and an output signal of the level shifter which are shown in FIG. 25.

FIG. 25 is a circuit diagram showing an example in which the mixing circuit shown in FIG. 17 and the level shifter shown in FIG. 18 are combined. FIG. 26 is a waveform diagram showing the input signals, the output signals of the mixing circuit, and the output signals of the level shifter which are shown in FIG. 25.

Referring to FIGS. 25 and 26, the signal generation unit 131 may generate input signals IN1, IN2, and IN3 with phases that are sequentially shifted using a shift register. The input signals IN1, IN2, and IN3 may transition between 0 V and 3.3 V.

A mixing circuit 12 may be connected between the signal generation unit 131 and the level shifter 140. The mixing circuit 12 may output three-step signals MOUT1, MOUT2, and MOUT3 by alternately outputting non-inverted signals and inverted signals of the input signals IN1, IN2, and IN3 received from the signal generation unit 131. The output signals MOUT1, MOUT2, and MOUT3 of the mixing circuit 12 are three-step signals having a reference level voltage of 0 V, a positive polarity voltage of 3.3 V, and a negative polarity voltage of −3.3 V.

The level shifter 140 receives the first and third input signals IN1 and IN3 from the signal generation unit 131, shifts the voltages of the input signals which is the three-step signal MOUT2 received from the mixing circuit 12, and outputs a three-step signal with a voltage higher than those of the input signals. The NOR gate of the level shifter 140 receives the first and third input signals IN1 and IN3 and the three-step signal MOUT2 received from the mixing circuit 12.

In the three-step signal received from the mixing circuit 12, the level shifter 140 may convert the positive polarity voltage of 3.3 V into the gate high voltage VGH (=22 V), convert the reference level voltage of 0 V into the gate low voltage VGL (=−3 V), and convert the negative polarity voltage of −3.3 V into the inverted voltage Vinv lower than the gate low voltage VGL.

When the demultiplexer 112 is a 1:K demultiplexer (here, K is a natural number of four or more) or when a shift clock CLK input to the gate driving unit 120 is a K-phase clock, the signal generation unit 131 may output first to Kth input signals with sequentially shifted phases. In this case, the mixing circuit may be implemented as a combination of two or more of the mixing circuit shown in FIG. 13, the mixing circuit shown in FIG. 17, the mixing circuit shown in FIG. 22, and the mixing circuit shown in FIG. 25. Also, the level shifter may be implemented as a combination of the level shifters that have been described in the above embodiments.

Figure 27:
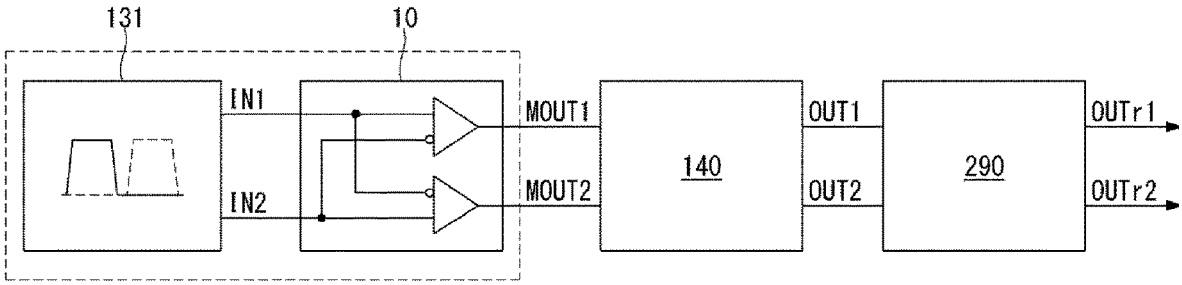
FIG. 27 is a diagram showing a recovery circuit connected to output nodes of the level shifter.

A two-step pulse may need to be input to the display panel driving circuit rather than a three-step pulse. In this case, the present disclosure may convert a three-step signal to a two-step signal using a recovery circuit and then supply the two-step signal to the display panel driving circuit. The recovery circuit may be connected between the mixing circuit and the level shifter or may be connected between the level shifter and the display panel driving circuit as shown in FIG. 27. The display panel driving circuit may include one or more of the data driving unit 110, the demultiplexer 112, and the gate driving unit 120.

The recovery circuit may be selectively enabled according to a preset option pin or a register setting value. The recovery circuit may be enabled or disabled under the control of the timing controller or the host system. Accordingly, according to the present disclosure, by adaptively enabling the recovery circuit according to a driving mode, a two-step signal or a three-step signal may be supplied to the display panel driving circuit as a control signal, a clock signal, or the like.

Figure 28:
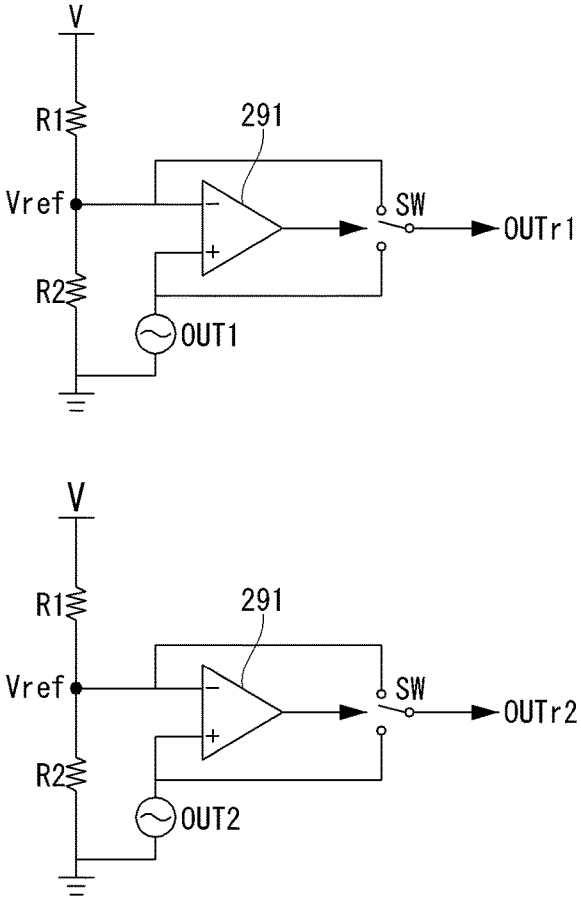
FIG. 28 is a circuit diagram specifically showing an example of the recovery circuit.
Figure 29:
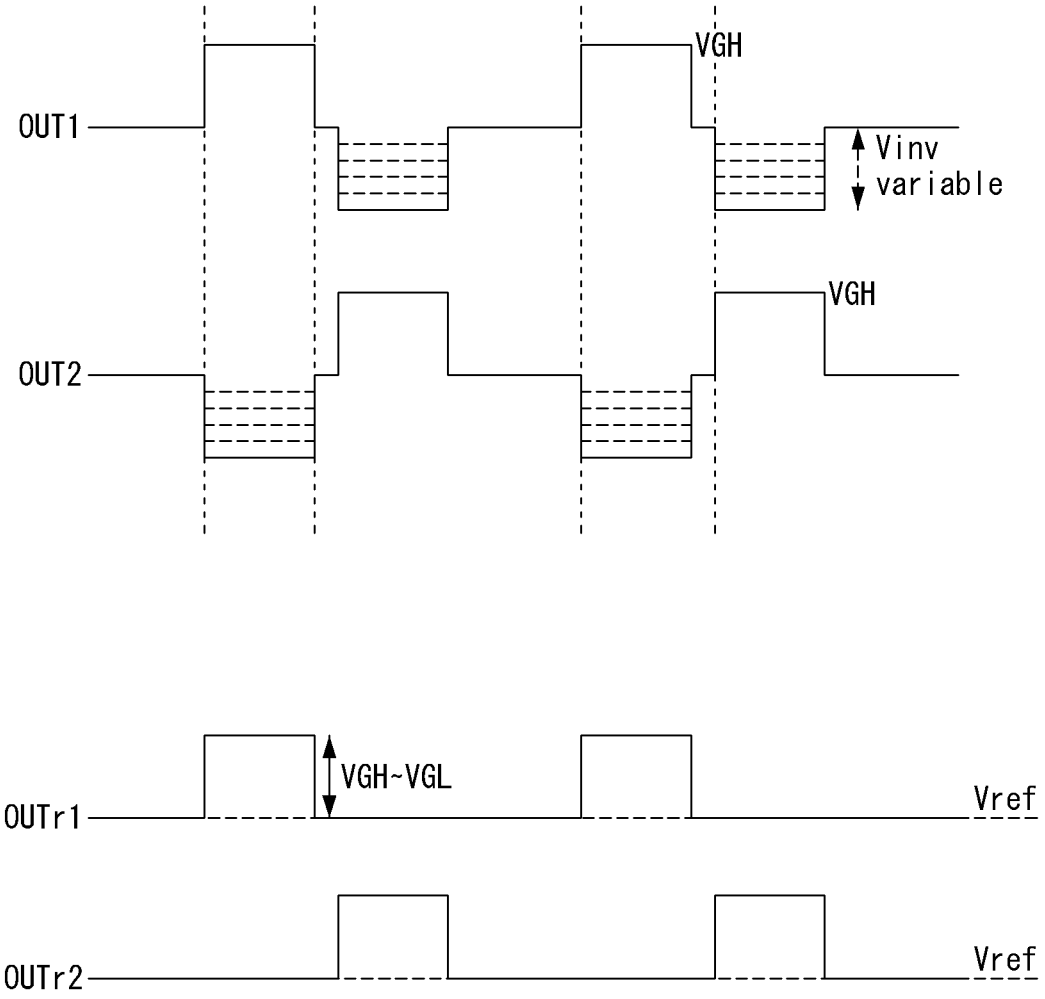
FIG. 29 is a waveform diagram showing output signals of the level shifter and the recovery circuit which are shown in FIG. 27.

FIG. 27 is a diagram showing a recovery circuit connected to output nodes of the level shifter. FIG. 28 is a circuit diagram specifically showing an example of the recovery circuit. FIG. 29 is a waveform diagram showing output signals of the level shifter and the recovery circuit which are shown in FIG. 27.

Referring to FIGS. 27 to 29, a recovery circuit 290 may be connected to the output node of the level shifter 140.

The recovery circuit 290 receives three-step signals OUT1 and OUT2 from the level shifter 140, converts the three-step signals OUT1 and OUT2 into two-step signals OUTr1 and OUTr2, and supplies the two-step signals OUTr1 and OUTr2 to the display panel driving circuit.

The three-step signals OUT1 and OUT2 output from the level shifter 140 are generated to have the gate high voltage, the gate low voltage VGL lower than the gate high voltage VGH, and the inverted voltage Vinv lower than the gate low voltage VGL, as shown in FIG. 29. The two-step signals output from the recovery circuit 290 are generated to have the gate high voltage VGH and the gate low voltage VGL as shown in FIG. 29.

The recovery circuit 290 includes a comparator 291 and a switch element SW as shown in FIG. 28. The switch element SW may be implemented as a transistor.

A reference voltage Vref is applied to an inverted input node of the comparator 291. The three-step signals OUT1 and OUT2 received from the level shifter 140 are input to a non-inverted input node of the comparator 291. The reference voltage Vref is set as a voltage obtained through division by resistors R1 and R2 constituting a voltage dividing circuit. The voltage dividing circuit includes resistors R1 and R2 connected in series between the high voltage V and the ground voltage GND and an output node between the resistors R1 and R2. The reference voltage Vref may be set to the gate low voltage VGL.

The switch element SW includes a first electrode connected to the output node of the voltage dividing circuit, a second electrode to which a three-step signal is applied from the level shifter 140, and a control electrode (or a gate) connected to the output node of the comparator 291. The output node of the level shifter 140 is connected to the non-inverted input node of the comparator 291 and the second electrode of the switch.

The comparator 291 outputs the high voltage when the voltage of the three-step signal OUT1 or OUT2 input from the level shifter 140 is higher than the reference voltage Vref. Conversely, the comparator 291 outputs the low voltage when the voltage of the three-step signal OUT1 or OUT2 input from the level shifter 140 is lower than or equal to the reference voltage Vref.

The switch element SW outputs the gate high voltage VGH of the three-step signal OUT1 or OUT2 in response to the high voltage of the comparator 291. The switch element SW outputs the reference voltage Vref in response to the low voltage of the comparator 291. Accordingly, the switch element SW outputs the gate high voltage VGH when the three-step signal OUT1 or OUT2 input from the level shifter 140 is the gate high voltage VGH, and outputs the reference voltage Vref, that is, the gate low voltage VGL, when the three-step signal OUT1 or OUT2 is the gate low voltage or the inverted voltage Vinv.

The output signal of the switch element SW is a two-step signal OUTr1 or OUTr2 which is generated to have the gate high voltage VGH or the gate low voltage. The two-step signals OUTr1 and OUTr2 may be supplied to the display panel driving circuit through signal lines.

A two-step output signal that is output from the recovery circuit 290 may be generated to have a gate high voltage VGH (=22 V) higher than the high voltage (=3.3 V) of a two-step input signal that is output from the signal generation unit 131 and a gate low voltage VGL (=−3 V) lower than the low voltage (=0 V) of the two-step input signal.

The above embodiments may be applied alone or in combination.

The display device according to an embodiment of the present disclosure may be described using the following various embodiments.

Embodiment 1

A display device may include a display panel including a plurality of neighboring pixels in areas where a plurality of data lines intersect a plurality of gate lines; a display panel driving circuit configured to write data to the pixels; a signal generation unit configured to generate a two-step signal for controlling the display panel driving circuit; a plurality of signal lines configured to connect the display panel driving circuit to the signal generation unit; and a signal inversion circuit configured to receive the two-step signal from the signal generation unit, invert the two-step signal, and supply three-step signals each including a positive polarity voltage, a reference level voltage, and a negative polarity voltage to the signal lines.

The three-step signals applied to the neighboring signal lines may have opposite phases.

Embodiment 2

The display panel driving circuit may include a data driving unit configured to supply a data signal to the data lines by supplying pixel data of an input image as the data signal; and a gate driving unit configured to supply a gate signal synchronized with the data signal to the gate lines. The three-step signals may be supplied to one or both of the data driving unit and the gate driving unit.

Embodiment 3

The display panel driving circuit may further include a demultiplexer connected between the data driving unit and the data lines to time-divisionally distribute the data signal to the data lines. The three-step signals may be supplied to a control node of the demultiplexer.

Embodiment 4

The two-step signal output from the signal generation unit may include first and second input signals with sequentially shifted phases.

The signal inversion circuit may include a level shifter configured to invert the first and second input signals, shift voltages of the first and second input signals, and output first and second three-step signals with opposite phases and voltages higher than the voltages of the first and second input signals.

Embodiment 5

The level shifter may include a first level shifter configured to output a gate high voltage higher than a high voltage of the first input signal in response to the first input signal and output an inverted voltage lower than a lower voltage of the second input signal in response to the second input signal; and a second level shifter configured to output the gate high voltage in response to the second input signal and output the inverted voltage in response to the first input signal.

Embodiment 6

The first level shifter may include a first-first switch element including a gate to which the first input signal is applied, a first electrode to which the gate high voltage is applied, and a second electrode connected to a first output node; a first-second switch element including a gate to which the second input signal is applied, a first electrode to which the inverted voltage is applied, and a second electrode connected to the first output node; a first NOR gate configured to output a NOR operation result of the first and second input signals; and a first-third switch element including a gate to which an output signal of the first NOR gate is applied, a first electrode connected to the first output node, and a second electrode to which a gate low voltage is applied.

The gate low voltage may be a voltage lower than the lower voltages of the first and second input signals. The inverted voltage may be a voltage lower than the gate low voltage.

Embodiment 7

The second level shifter may include a second-first switch element including a gate to which the second input signal is input, a first electrode to which the gate high voltage is applied, and a second electrode connected to a second output node; a second-second switch element including a gate to which the first input signal is applied, a first electrode to which the inverted voltage is applied, and a second electrode connected to the second output node; a second NOR gate configured to output a NOR operation result of the first and second input signals; and a second-third switch element including a gate to which an output signal of the second NOR gate is applied, a first electrode connected to the second output node, and a second electrode to which the gate low voltage is applied.

Embodiment 8

The two-step signal output from the signal generation unit may include first and second input signals with sequentially shifted phases.

The signal inversion circuit may include a mixing circuit configured to output first and second three-step signals with opposite phases and with a high voltage, a reference level voltage, and a low voltage using the first and second input signals; and a level shifter configured to output first and second three-step signals with increased voltages by increasing high voltages of the first and second three-step signals to a gate high voltage, converting a reference level voltage of the first and second three-step signals into a gate low voltage, and converting low voltages of the first and second three-step signals into an inverted voltage lower than the gate low voltage.

Embodiment 9

The mixing circuit may include a resistor connected between first and second output nodes; a first switch element including a gate to which the first input signal is input, a first electrode connected to a constant current source, and a second electrode connected to the first output node; a second switch element including a gate to which the first input signal is input, a first electrode connected to the second output node, and a second electrode connected to a ground voltage source; a third switch element including a gate to which the second input signal is input, a first electrode connected to the constant current source, and a second electrode connected to the second output node; and a fourth switch element including a gate to which the second input signal is input, a first electrode connected to the first output node, and a second electrode connected to the ground voltage source.

Embodiment 10

The signal generation unit may output first, second, and third input signals with sequentially shifted phases.

The signal inversion circuit may include a mixing circuit configured to invert the input signals and output first, second, and third three-step signals; and a level shifter configured to output first, second, and third three-step signals with increased voltages by increasing high voltages of the first, second, and third three-step signals to a gate high voltage, converting a reference level voltage of the first, second, and third three-step signals into a gate low voltage, and converting low voltages of the first, second, and third three-step signals into an inverted voltage lower than the gate low voltage.

Embodiment 11

The signal generation unit may output first, second, and third input signals with sequentially shifted phases.

The signal inversion circuit may include a mixing circuit configured to invert the input signals and output first, second, and third three-step signals; and a level shifter configured to output first, second, and third three-step signals with increased voltages by increasing high voltages of the first, second, and third three-step signals to a gate high voltage, converting a reference level voltage of the first, second, and third three-step signals into a gate low voltage, and converting low voltages of the first, second, and third three-step signals into an inverted voltage lower than the gate low voltage.

The mixing circuit may include a first mixing circuit configured to receive the first and second input signals and alternately output non-inverted signals and inverted signals of the first and second input signals to output the first three-step signal; a second mixing circuit configured to receive the second and third input signals and alternately output non-inverted signals and inverted signals of the second and third input signals to output the second three-step signal; and a third mixing circuit configured to receive the first and third input signals and alternately output non-inverted signals and inverted signals of the first and third input signals to output the third three-step signal.

Embodiment 12

The signal generation unit may output first, second, and third input signals with sequentially shifted phases.

The signal inversion circuit may include a mixing circuit configured to invert the input signals and output first, second, and third three-step signals; and a level shifter configured to output a step signal with an increased voltage by receiving one or more of the input signals and one or more of the three-step signals, increasing high voltages of the three-step signals to a gate high voltage, converting a reference level voltage of the three-step signals into a gate low voltage, and converting low voltages of the three-step signals into an inverted voltage lower than the gate low voltage.

Embodiment 13

A display device may include a display panel including a plurality of neighboring pixels in areas where a plurality of data lines intersect a plurality of gate lines; a display panel driving circuit configured to write data to the pixels; a signal generation unit configured to generate a two-step input signal for controlling the display panel driving circuit; a plurality of signal lines configured to connect the display panel driving circuit to the signal generation unit; a signal inversion circuit configured to receive the two-step input signal from the signal generation unit, invert the two-step input signal, and convert the two-step input signal into three-step signals each including a positive polarity voltage, a reference level voltage, and a negative polarity voltage; and a recovery circuit configured to convert the three-step signals received from the signal inversion circuit into a two-step output signal and supply the two-step output signal to the signal lines.

The two-step output signal may be generated to have a gate high voltage higher than a high voltage of the two-step input signal and a gate low voltage lower than a low voltage of the two-step input signal.

Embodiment 14

The display panel driving circuit may include a data driving unit configured to supply a data signal to the data lines by supplying pixel data of an input image as the data signal; and a gate driving unit configured to supply a gate signal synchronized with the data signal to the gate lines.

The two-step output signal may be supplied to one or both of the data driving unit and the gate driving unit.

Embodiment 15

The display panel driving circuit may further include a demultiplexer connected between the data driving unit and the data lines to time-divisionally distribute the data signal to the data lines.

The two-step output signal may be supplied to a control node of the demultiplexer.

Embodiment 16

The two-step input signal output from the signal generation unit may include first and second input signals with sequentially shifted phases.

The signal inversion circuit may include a level shifter configured to invert the first and second input signals, shift voltages of the first and second input signals, and output first and second three-step signals with opposite phases and voltages higher than the voltages of the first and second input signals.

Embodiment 17

The two-step input signal output from the signal generation unit may include first and second input signals with sequentially shifted phases.

The signal inversion circuit may include a mixing circuit configured to output first and second three-step signals with opposite phases and with a high voltage, a reference level voltage, and a low voltage using the first and second input signals; and a level shifter configured to output first and second three-step signals with increased voltages by increasing high voltages of the first and second three-step signals to a gate high voltage, converting a reference level voltage of the first and second three-step signals into a gate low voltage, and converting low voltages of the first and second three-step signals into an inverted voltage lower than the gate low voltage.

Embodiment 18

The recovery circuit may convert the three-step signals input from the level shifter into the gate high voltage and the gate low voltage and output the two-step output signal.

Embodiment 19

The recovery circuit may include a comparator configured to compare the three-step signals to a reference voltage; and a switch element controlled according to an output voltage of the comparator to output the gate high voltage when the three-step signals are higher than the reference voltage and output the gate low voltage when the three-step signals are lower than or equal to the reference voltage.

The reference voltage may be set to the gate low voltage.

The driving method of the display device according to an embodiment of the present disclosure may be described using the following various embodiments.

Embodiment 1

A driving method of a display device may include generating a two-step input signal for controlling a display panel driving circuit; generating three-step signals each including a positive polarity voltage, a reference level voltage, and a negative polarity voltage by receiving and inverting the two-step input signal; and controlling the display panel driving circuit by supplying the three-step signals to a plurality of signal lines connected to the display panel driving circuit.

The three-step signals applied to the neighboring signal lines may have opposite phases.

Embodiment 2

A driving method of a display device may include generating a two-step input signal for controlling a display panel driving circuit; generating three-step signals each including a positive polarity voltage, a reference level voltage, and a negative polarity voltage by receiving and inverting the two-step input signal; converting the three-step signals into a two-step output signal; and controlling the display panel driving circuit by supplying the two-step output signal to a plurality of signal lines connected to the display panel driving circuit. The two-step output signal may be generated to have a gate high voltage higher than a high voltage of the two-step input signal and a gate low voltage lower than a low voltage of the two-step input signal.

According to the present disclosure, by inverting an output signal of a signal generation unit that generates a control signal for controlling a display panel driving circuit, signals with opposite phases are supplied to neighboring signal lines. Accordingly, according to the present disclosure, by implementing a field cancelation effect without the addition of a separate signal line, it is possible to remove or reduce EMI and noise in signal lines.

Also, according to the present disclosure, by reducing and recovering gate bias stress of transistors of a display panel driving circuit using an inverted signal, it is possible to reduce deterioration of the transistors used in the display panel driving circuit.

Also, according to the present disclosure, a three-step signal output from a level shifter may be converted into a two-step signal using a recovery circuit and then may be supplied to a display panel driving circuit. The recovery circuit may be selectively enabled according to a preset option pin or a register setting value. The recovery circuit may be enabled or disabled under the control of a timing controller or a host system. Accordingly, according to the present disclosure, by adaptively enabling the recovery circuit according to a driving mode, a two-step signal or a three-step signal may be supplied to the display panel driving circuit as a control signal, a clock signal, or the like.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. display device comprising:

a display panel including a plurality of pixels in adjacent areas where a plurality of data lines overlaps with a plurality of gate lines;

a display panel driving circuit configured to write data to the pixels;

a signal generation unit configured to generate signals in a two-step waveform for controlling the display panel driving circuit, the signals in the two-step waveform including a first signal and a second signal;and a signal inversion circuit in the display panel driving circuit configured to receive the first signal in the two-step waveform and the second signal in the two-step waveform from the signal generation unit, invert the first signal in the two-step waveform and the second signal in the two-step waveform to supply the first signal in a three-step waveform and the second signal in the three-step waveform to the display panel driving circuit, wherein the first signal in the three-step waveform and the second signal in the three-step waveform are applied to a first signal line of a plurality of signal lines connected to the display panel driving circuit and a second signal line of the plurality of signal lines adjacent to the first signal line, respectively.

2. The display device of claim 1, wherein the display panel driving circuit includes:

a data driving unit configured to supply a data signal to the data lines by supplying pixel data of an input image as the data signal; and a gate driving unit configured to supply a gate signal synchronized with the data signal to the gate lines, and the first signal in the three-step waveform and the second signal in the three-step waveform are supplied to one or both of the data driving unit and the gate driving unit.

3. The display device of claim 2, wherein the display panel driving circuit further comprises a demultiplexer connected between the data driving unit and the data lines to time-divisionally distribute the data signal to the data lines, and the first signal in the three-step waveform and the second signal in the three-step waveform are supplied to a control node of the demultiplexer.

4. The display device of claim 1, wherein the first signal and the second signal from the signal generation unit have phases that are sequentially shifted, and the signal inversion circuit includes a level shifter configured to invert the first and second signals in the two-step waveform, shift voltages of the first and second signals in the two-step waveform, and output the first signal in the three-step signal waveform and the second signal in the three-step signal waveform that have phases opposite to each other with voltages higher than the voltages of the first and second signals.

5. The display device of claim 4, wherein the level shifter includes:

a first level shifter configured to output a gate high voltage higher than a high voltage of the first signal in the two-step waveform in response to the first signal in the two-step waveform and output an inverted voltage lower than a lower voltage of the second signal in the two-step waveform in response to the second signal in the two-step waveform; and a second level shifter configured to output the gate high voltage in response to the second signal in the two-step waveform and output the inverted voltage in response to the first signal in the two-step waveform.

6. The display device of claim 5, wherein the first level shifter includes:

a first-first switch element including a gate to which the first signal is applied, a first electrode to which the gate high voltage is applied, and a second electrode connected to a first output node;

a first-second switch element including a gate to which the second signal is applied, a first electrode to which the inverted voltage is applied, and a second electrode connected to the first output node;

a first NOR gate configured to output a NOR operation result of the first and second signals; and a first-third switch element including a gate to which an output signal of the first NOR gate is applied, a first electrode connected to the first output node, and a second electrode to which a gate low voltage is applied, wherein the gate low voltage is a voltage lower than the low voltages of the first and second signals and the inverted voltage is a voltage lower than the gate low voltage.

7. The display device of claim 6, wherein the second level shifter includes:

a second-first switch element including a gate to which the second signal is input, a first electrode to which the gate high voltage is applied, and a second electrode connected to a second output node;

a second-second switch element including a gate to which the first signal is applied, a first electrode to which the inverted voltage is applied, and a second electrode connected to the second output node;

a second NOR gate configured to output a NOR operation result of the first and second signals; and a second-third switch element including a gate to which an output signal of the second NOR gate is applied, a first electrode connected to the second output node, and a second electrode to which the gate low voltage is applied.

8. The display device of claim 1, wherein the first signal in the two-step waveform and the second signal in the two-step waveform from the signal generation unit have phases that are sequentially shifted, and the signal inversion circuit includes:

a mixing circuit configured to output the first signal in the three-step waveform and the second signal in the three-step waveform with opposite phases and with a high voltage, a reference level voltage, and a low voltage using the first and second signals in the two-step waveform; and a level shifter configured to output the first signal in the three-step wave form and the second signal in the three-step waveform with increased voltages by increasing high voltages of the first and second signals in the three-step waveform to a gate high voltage, converting a reference level voltage of the first and second signals in the three-step waveform into a gate low voltage, and converting low voltages of the first and second signals in the three-step waveform into an inverted voltage lower than the gate low voltage.

9. The display device of claim 8, wherein the mixing circuit includes:

a resistor connected between first and second output nodes;

a first switch element including a gate to which the first signal is input, a first electrode connected to a constant current source, and a second electrode connected to the first output node;

a second switch element including a gate to which the first signal is input, a first electrode connected to the second output node, and a second electrode connected to a ground voltage source;

a third switch element including a gate to which the second signal is input, a first electrode connected to the constant current source, and a second electrode connected to the second output node; and a fourth switch element including a gate to which the second signal is input, a first electrode connected to the first output node, and a second electrode connected to the ground voltage source.

10. The display device of claim 1, wherein the signal generation unit further outputs a third signal, and the first signal, the second signal, and the third signal have phases that are sequentially shifted, the signal inversion circuit includes:

a mixing circuit configured to invert the first signal in the two-step waveform, the second signal in the two-step waveform, and the third signal in the two-step waveform and output the first signal in the three-step waveform, the second signal in the three-step waveform, and the third signal in the three-step waveform; and a level shifter configured to output the first signal in the three-step waveform, the second signal in the three-step waveform, and the third three-step signal in the three-step waveform with increased voltages by increasing high voltages of the first, second, and third signals in the three-step waveform to a gate high voltage, converting a reference level voltage of the first, second, and third signals in the three-step waveform into a gate low voltage, and converting low voltages of the first, second, and third signals in the three-step waveform into an inverted voltage lower than the gate low voltage.

11. The display device of claim 1, wherein the signal generation unit further outputs a third signal, and the first signal, the second signal, and the third signal have phases that are sequentially shifted, the signal inversion circuit includes:

a mixing circuit configured to invert the first signal in the two-step waveform, the second signal in the two-step waveform, and the third signal in the two-step waveform and output the first signal in the three-step waveform, the second signal in the three-step waveform, and the third signal in the three-step waveform; and a level shifter configured to output the first signal in the three-step waveform, the second signal in the three-step waveform, and the third signal in the three-step waveform with increased voltages by increasing high voltages of the first, second, and third signals in the three-step waveform to a gate high voltage, converting a reference level voltage of the first, second, and third signals in the three-step waveform into a gate low voltage, and converting low voltages of the first, second, and third signals in the three-step waveform into an inverted voltage lower than the gate low voltage, and the mixing circuit includes:

a first mixing circuit configured to receive the first and second signals in the two-step waveform and alternately output non-inverted signals and inverted signals of the first and second signals in the two-step waveform to output the first signal in the three-step waveform;

a second mixing circuit configured to receive the second and third signals in the two-step waveform and alternately output non-inverted signals and inverted signals of the second and third signals in the two-step waveform to output the second signal in the three-step waveform; and a third mixing circuit configured to receive the first and third signals in the two-step waveform and alternately output non-inverted signals and inverted signals of the first and third signals in the two-step waveform to output the third signal in the three-step waveform.

12. The display device of claim 1, wherein the signal generation unit further outputs a third signal , and the first signal, the second signal, and the third signal have phases that are sequentially shifted, the signal inversion circuit includes:

a mixing circuit configured to invert the first signal in the two-step waveform, the second signal in the two-step waveform, and the third signal in the two-step waveform and output the first signal in the three-step waveform, the second signal in the three-step waveform, and the third signal in the three-step waveform; and a level shifter configured to output a step signal with an increased voltage by receiving one or more of the signals in the three-step waveform, increasing high voltages of the signals in the three-step waveform to a gate high voltage, converting a reference level voltage of the signals in the three-step waveform into a gate low voltage, and converting low voltages of the signals in the three-step waveform into an inverted voltage lower than the gate low voltage.

13. A display device comprising:

a display panel including a plurality of neighboring pixels in areas where a plurality of data lines intersect a plurality of gate lines;

a display panel driving circuit configured to write data to the pixels;

a signal generation unit configured to generate a two-step input signal for controlling the display panel driving circuit;

a signal inversion circuit configured to receive the two-step input signal from the signal generation unit, invert the two-step input signal, and convert the two-step input signal into three-step signals each including a positive polarity voltage, a reference level voltage, and a negative polarity voltage; and a recovery circuit configured to convert the three-step signals received from the signal inversion circuit into a two-step output signal and supply the two-step output signal to the display panel driving circuit signal.

14. The display device of claim 13, wherein the display panel driving circuit includes:

a data driving unit configured to supply a data signal to the data lines by supplying pixel data of an input image as the data signal; and a gate driving unit configured to supply a gate signal synchronized with the data signal to the gate lines, and the two-step output signal is supplied to one or both of the data driving unit and the gate driving unit.

15. The display device of claim 13, wherein the display panel driving circuit further comprises a demultiplexer connected between the data driving unit and the data lines to time-divisionally distribute the data signal to the data lines, and the two-step output signal is supplied to a control node of the demultiplexer.

16. The display device of claim 13, wherein the two-step input signal output from the signal generation unit includes first and second input signals with sequentially shifted phases, and the signal inversion circuit includes a level shifter configured to invert the first and second input signals, shift voltages of the first and second input signals, and output first and second three-step signals with opposite phases and voltages higher than the voltages of the first and second input signals, wherein the recovery circuit converts the three-step signals input from the level shifter into a gate high voltage and a gate low voltage and outputs the two-step output signals.

17. The display device of claim 13, wherein the two-step input signal output from the signal generation unit includes first and second input signals with sequentially shifted phases, and the signal inversion circuit comprises:

a mixing circuit configured to output first and second three-step signals with opposite phases and with a high voltage, a reference level voltage, and a low voltage using the first and second input signals; and a level shifter configured to output first and second three-step signals with increased voltages by increasing high voltages of the first and second three-step signals to a gate high voltage, converting a reference level voltage of the first and second three-step signals into a gate low voltage, and converting low voltages of the first and second three-step signals into an inverted voltage lower than the gate low voltage, wherein the recovery circuit converts the three-step signals input from the level shifter into the gate high voltage and the gate low voltage and outputs the two-step output signal.

18. The display device of claim 13, wherein the recovery circuit includes:

a comparator configured to compare the three-step signals to a reference voltage; and a switch element controlled according to an output voltage of the comparator to output the gate high voltage when the three-step signals are higher than the reference voltage and output the gate low voltage when the three-step signals are lower than or equal to the reference voltage, and wherein the reference voltage is set to the gate low voltage.

19. A driving method of a display device, the driving method comprising:

generating a two-step input signal for controlling a display panel driving circuit;

generating three-step signals by inverting the two-step input signal; and controlling the display panel driving circuit by supplying the three-step signals to the display panel driving circuit, wherein the three-step signals applied to the neighboring signal lines have opposite phases.

20. The method of claim 19, wherein a voltage of the three-step signals is greater than a voltage of the two-step input signal.

* * * * *